US007628505B2

(12) United States Patent
Flaherty

(10) Patent No.: US 7,628,505 B2
(45) Date of Patent: Dec. 8, 2009

(54) EXTRUDED LIGHTED ASSEMBLY

(75) Inventor: Richard A Flaherty, Grapeview, WA (US)

(73) Assignee: Leader Manufacturing, Inc., Port Orchard, WA (US)

( * ) Notice: Subject to any disclaimer, the term of this patent is extended or adjusted under 35 U.S.C. 154(b) by 493 days.

(21) Appl. No.: 11/472,900

(22) Filed: Jun. 22, 2006

(65) Prior Publication Data

US 2007/0008717 A1 Jan. 11, 2007

Related U.S. Application Data

(60) Provisional application No. 60/696,955, filed on Jul. 6, 2005.

(51) Int. Cl.
*F21S 4/00* (2006.01)

(52) U.S. Cl. ..... 362/217.01; 362/147; 362/217.1; 362/217.05

(58) Field of Classification Search ..... 362/153, 362/153.1, 235, 249, 267
See application file for complete search history.

(56) References Cited

U.S. PATENT DOCUMENTS

| | | | | |
|---|---|---|---|---|
| 1,034,211 | A | 7/1912 | De Palma | |
| 1,629,946 | A | 5/1927 | Angel | |
| 3,521,047 | A | 7/1970 | Smith | |
| 5,134,550 | A | 7/1992 | Young | |
| 5,829,913 | A | 11/1998 | Puckett | |
| 6,530,675 | B1 * | 3/2003 | Van Etten | 362/267 |
| 6,592,238 | B2 | 7/2003 | Cleaver et al. | |
| 6,705,751 | B1 | 3/2004 | Liu | |
| 7,086,769 | B1 * | 8/2006 | Thompson et al. | 362/559 |
| 2005/0276045 | A1 * | 12/2005 | Kovacik et al. | 362/247 |

* cited by examiner

*Primary Examiner*—Ali Alavi
(74) *Attorney, Agent, or Firm*—Van Dyke, Gardner, Linn & Burkhart, LLP

(57) ABSTRACT

A lighted assembly includes a support having a wall and a light assembly with a light source and a body, which includes a light emitting surface. The light source is coupled to the body and is adapted for coupling to a power source for powering the light source. When powered light from the light source is directed into the body and is directed from the body through the light emitting surface. The support includes a corresponding recess formed in the wall, with the light assembly being mounted in the recess and facing outwardly from the support to thereby direct light outwardly from the support.

29 Claims, 38 Drawing Sheets

EXTRUDED LIGHTED ASSEMBLY

This application is related to and claims the benefit of provisional application entitled EXTRUDED LIGHTED POST ASSEMBLY, Ser. No. 60/696,955, filed Jul. 6, 2005, which is herein incorporated by reference in its entirety.

The present invention generally relates to lighted assemblies and, more particularly, to lighted assemblies that may be used as bollards or pathway lights.

Lighted posts have been used for years to light the entrance way of a building or a residence or to light an area, such as a walkway or deck, including a pool deck. Most residential lights are formed from a support post and a housing that is mounted to the post. The housing typically houses one or more lights, such as halogen lights or the like, and incorporates light transmitting openings through which the light passes to illuminate the ground or the post itself. Some light transmitting openings have covers or lenses to diffuse or direct the light. Other openings are left uncovered. A lighted post may also be formed from a tubular member that provides a support, as well as a housing for the light. These lighted posts tend to be used in commercial applications—and are referred to as bollards.

However, the light sources used in conventional lighted posts produce a significant amount of heat and, further, consume a considerable amount of energy. If the light sources are energized for a significant length of time the housing may become quite hot. Consequently, the housings typically incorporate louvers to allow air flow through the housing to cool the air in the housing and, hence, cool the housing. These louvers or openings, however, tend to detract from the appearance of the housing. In addition, the light is generated by discrete light sources that results overlapping puddles of light, which produce a non-uniform light intensity.

Consequently, there is a need for a lighted assembly that can be assembled in a manner to eliminate the need for louvers and, further, to reduce its power consumption.

SUMMARY OF THE INVENTION

Accordingly, the present invention provides a lighted assembly that can be assembled in a manner to eliminate the need for louvers and, further, configured in a manner to reduce its power consumption.

In one form of the invention, a lighted assembly includes a support and a light assembly. The support includes at least one recess formed in the wall of the support that extends over at least a portion of the longitudinal length of the support. The light assembly includes a light transmitting body with a light emitting surface and at least one light source that, when powered, emits light into the body, which light is then emitted through the light emitting surface. The light assembly is mounted in the support such that at least a portion of the light assembly is positioned in the recess of the wall of the support.

In one aspect, the support has a generally rectangular or square cross-section, and the recess is located in one of the corners of the wall of the support. Alternately, the recess is located in a side of the support between two corners of the wall of the support.

In another aspect, the support has a generally triangular-shaped cross-section. Similarly, the recess may be located in one of the corners of the wall of the support or in one of the sides of the support between two corners.

According to another aspect, the support comprises an extruded member with the recess formed in the wall of the support during the extrusion process. Preferably, the support includes a plurality of recesses formed on the wall of the support. A light assembly is provided at each of the recesses. For example, where the support has a rectangular cross-section, each corner or each side may include a recess so that the lighted assembly has at least four light assemblies. In some applications, two or more light assemblies may be provided at each recess either adjacent to each other or in a stacked arrangement.

In yet a further aspect, each recess may be covered by a light transmitting cover to enclose the light assembly in the support. For example, the cover may be mounted at the recess, for example, by a snap-fit connection with the wall of the support. Similarly, the light assembly or assemblies may be mounted in the support by engagement with the wall of the support. For example, the recess of the support may be formed with a slotted groove that is defined between two free edges that are sized to engage the body of the light assembly. Where the recess extends to one end of the support, the slotted groove may be similarly extended to the same end of the support such that the light assembly may be mounted in the support by inserting the light assembly through the same end of the support and with the body of the support inserted into the slotted groove.

In a further aspect, the recess and the slotted groove extend the full length of the support so that the light assembly may be inserted from either end of the support. In addition, the ends of the support may include covers that close the open ends of the recesses, with one of the covers forming a base plate for mounting the support to a surface, such as the ground, a deck or the like.

According to yet another aspect, the light transmitting body of each light assembly is configured to diffuse the light from the light source in a manner so that when light is emitted by the light emitting surface it has a substantially uniform light intensity pattern. For example, the body of the light assembly may comprise a waveguide. In preferred form, the light source comprises a plurality of light emitting diodes, such as a plurality of high intensity light emitting diodes, that are arranged as a string of LEDs, so that the light emitted from the light assemblies forms a light of diffused light similar to a neon light.

According to another form of the invention, a lighted assembly includes a support, a cover, and at least one light assembly. The support is adapted to mount on or in a ground surface or a base and comprises a hollow member with an upper open end, which is closed by the cover, and a lower open end. The light assembly includes a plurality of light emitting diodes and a light transmitting body with a light emitting surface and is adapted for coupling to a power source for powering the diodes. The hollow member is formed with at least one recess that extends along the longitudinal length of the hollow member. The light assembly is mounted in the support such that at least a portion of the light transmitting body is located in the recess so that light projects outwardly from the recess of the support.

In one aspect, the hollow member comprises an extruded aluminum member with a plurality of recesses and a corresponding plurality of light assemblies. Further, the central portion of the support includes a central passageway that extends from one end of the support to the other end of the support. Further, the recesses preferably are in communication with the central passageway so that, while the light assemblies are located in the recesses, power wires or cables may be extended through the passageway for connection with the light assemblies through the wall of the hollow member.

In a further aspect, each light assembly is enclosed in its respective recess by a cover. For example, the cover may be configured to engage the wall of the support to provide a snap-fit mounting of the cover to the support.

In one aspect, the support comprises a round, rectangular, or triangular extruded hollow aluminum member. For example, in the case of the rectangular or triangular extruded hollow aluminum members, the recesses may be formed at the corners or in the sides of the support between the corners. For example, when located in the corners, the covers may be configured to follow the outermost perimeter of the support so that the covers do not project outwardly from the support. Alternately, the covers may be configured so that they project outwardly from the outermost perimeter of the support.

Accordingly, the lighted assembly of the present invention is particularly suitable for use as a bollard or as a pathway light. The lighted assembly consumes less energy and produces less heat than conventional lights and, further, significantly reduces, if not eliminates, bug or dirt intrusion into the light because the lighted assemblies can be enclosed and, optionally, sealed in the support. These and other objects, advantages, purposes, and features of the invention will become more apparent from the study of the following description taken in conjunction with the drawings.

DETAILED DESCRIPTION OF THE DRAWINGS

Figure 7:
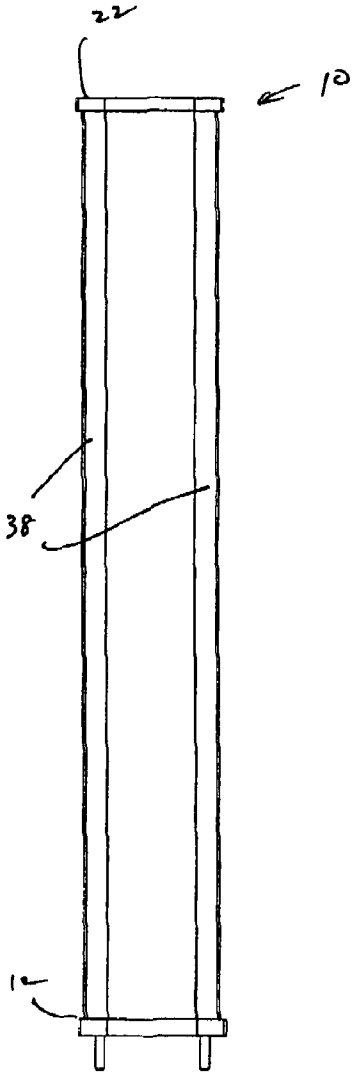
FIG. 7 is a rear elevation view of the lighted post of FIG. 2.
Figure 6:
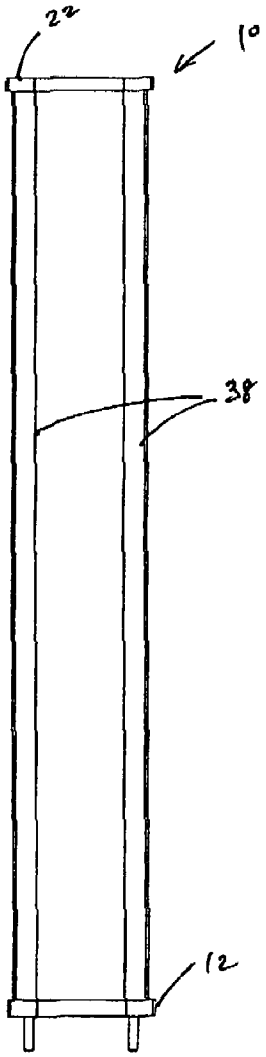
FIG. 6 is a right side elevation view of the lighted post of FIG. 2.
Figure 5:
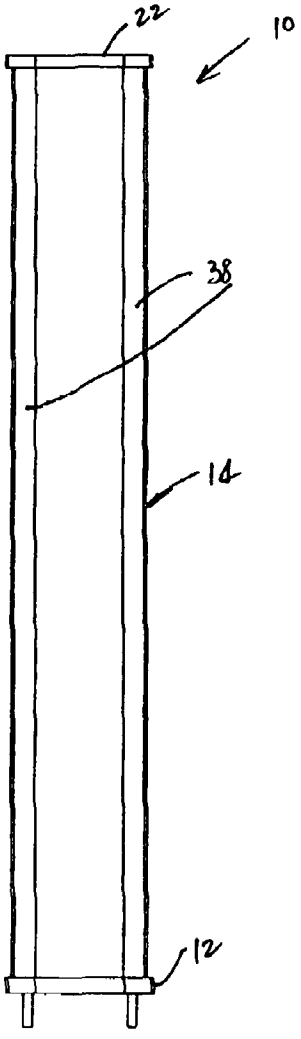
FIG. 5 is a left side elevation view of the lighted post of FIG. 2.
Figure 7A:
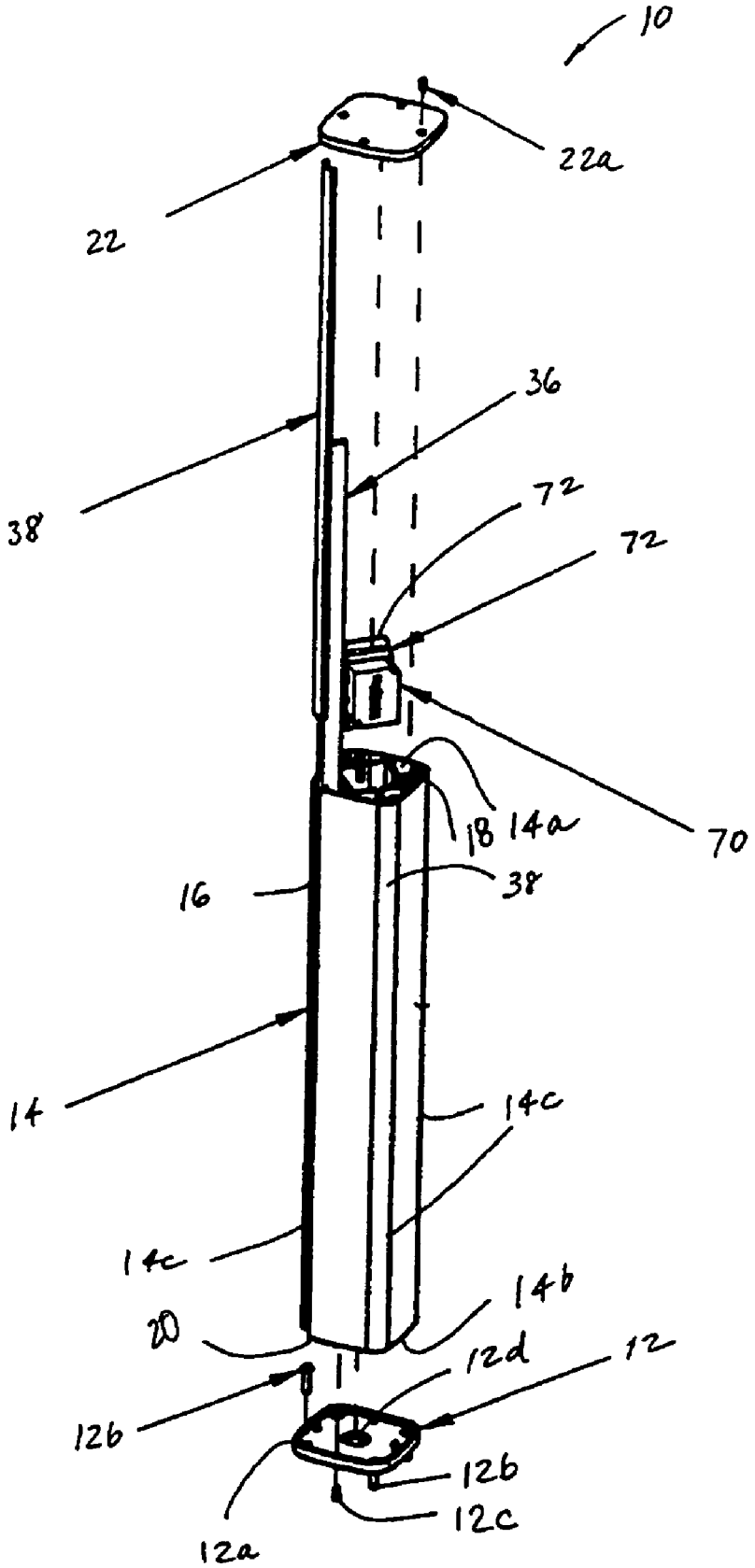
FIG. 7A is an exploded perspective view of the lighted post of FIG. 1.
Figure 7B:
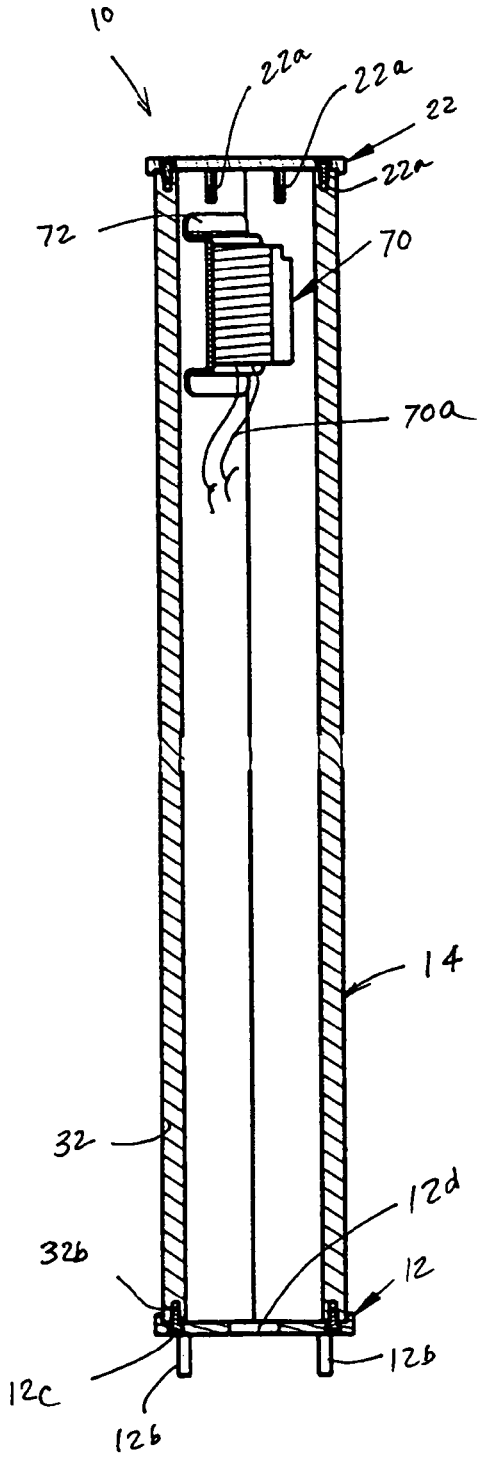
FIG. 7B is a cross-section taken along line VIIB-VIIB of FIG. 3.
Figure 7C:
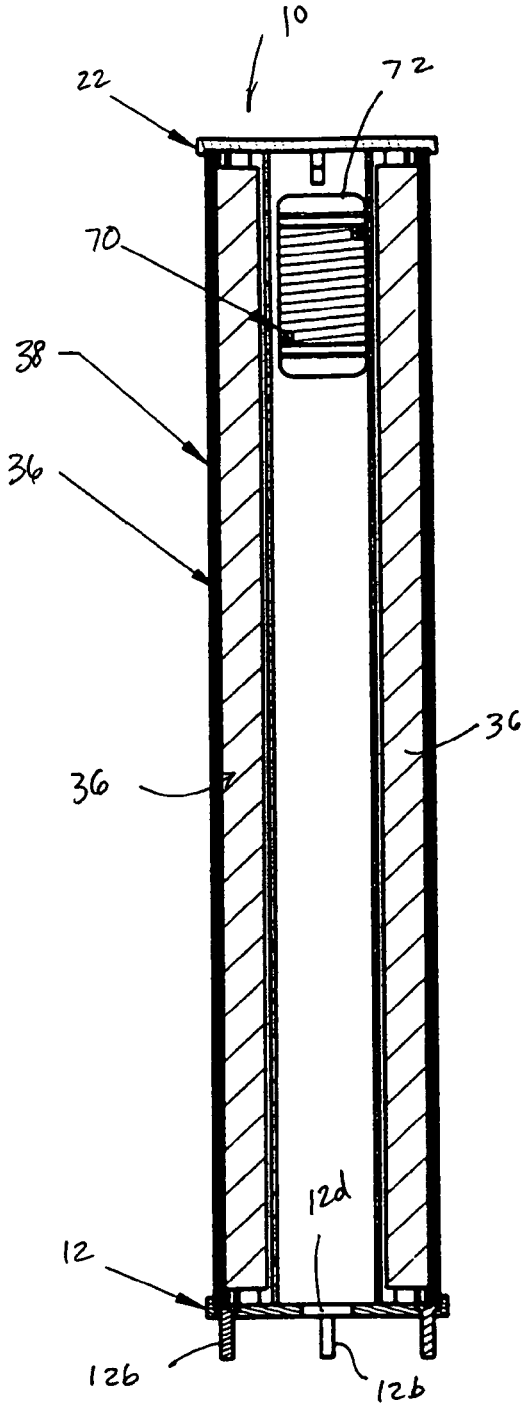
FIG. 7C is a cross-section taken along line VIIC-VIIC of FIG. 3.
Figure 7D:
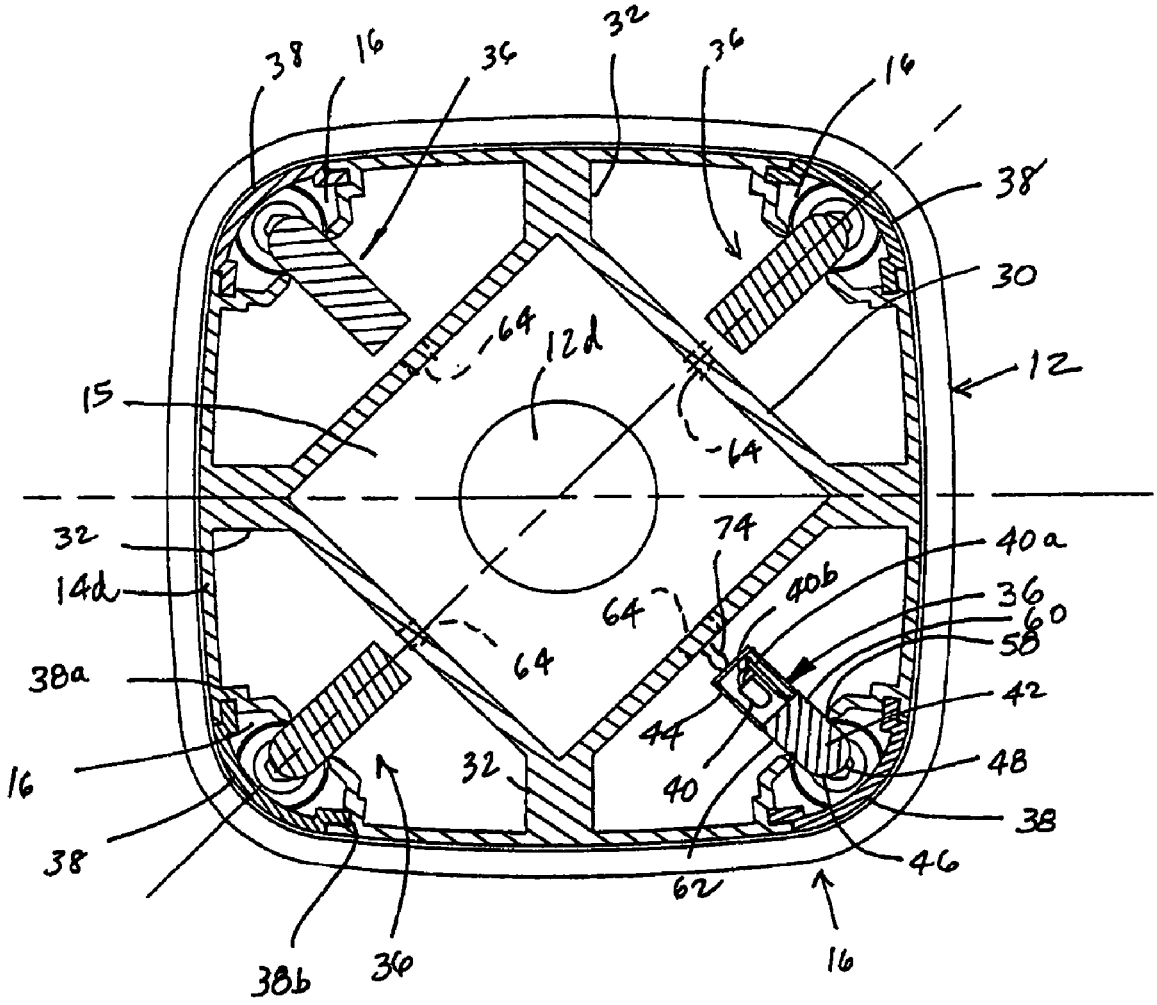
FIG. 7D is a cross-section taken along line VIID-VIID of FIG. 2.
Figure 7E:
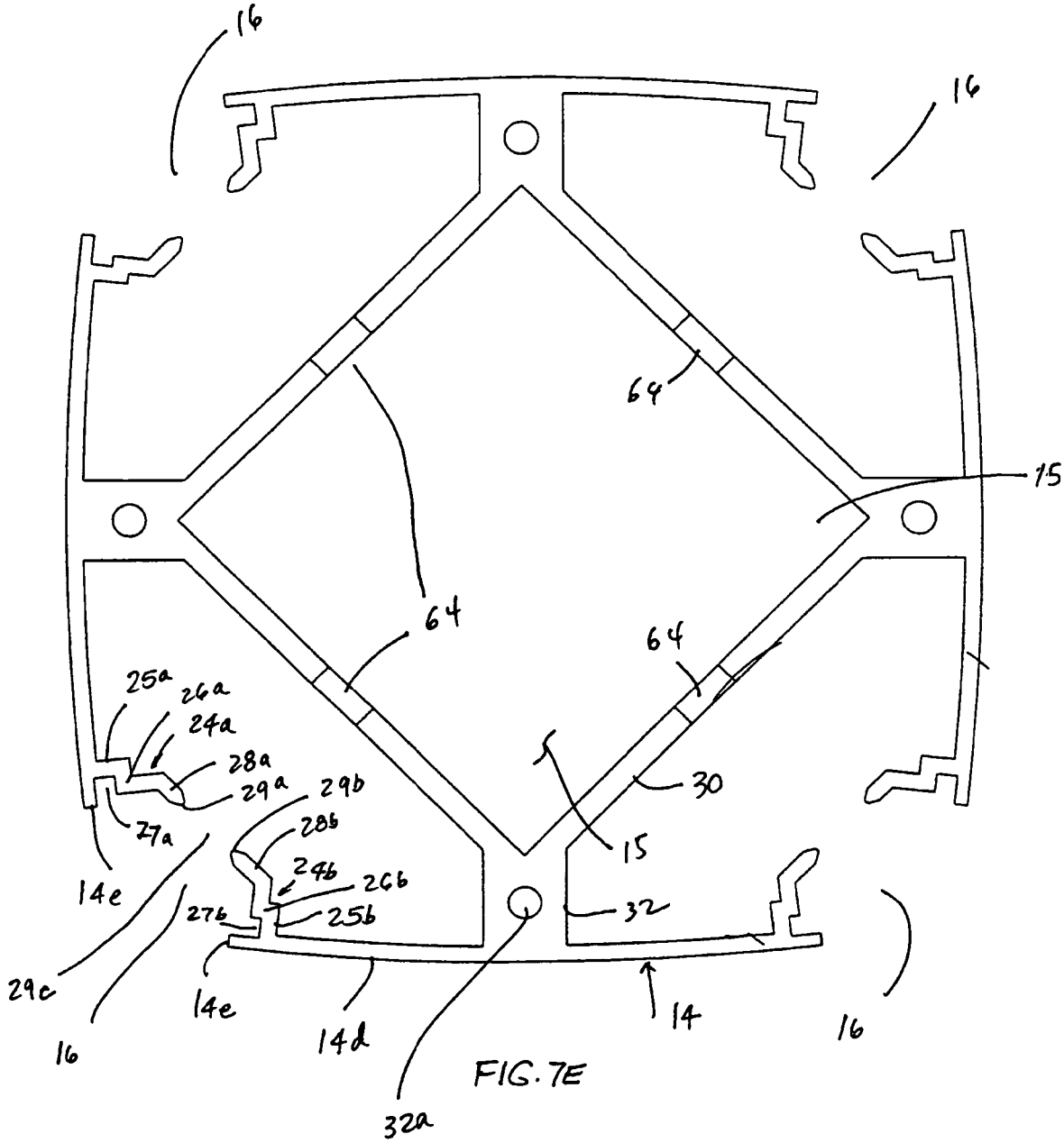
FIG. 7E is a top end view of the post of FIG. 2 with the covers and light assemblies removed for clarity.
Figure 8:
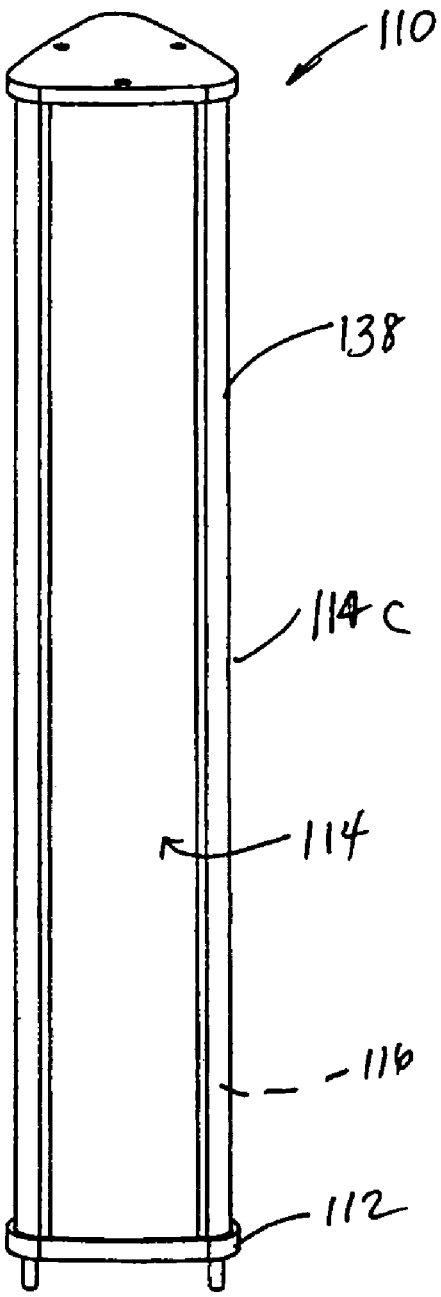
FIG. 8 is a perspective view of another embodiment of the lighted post of the present invention.
Figure 9:
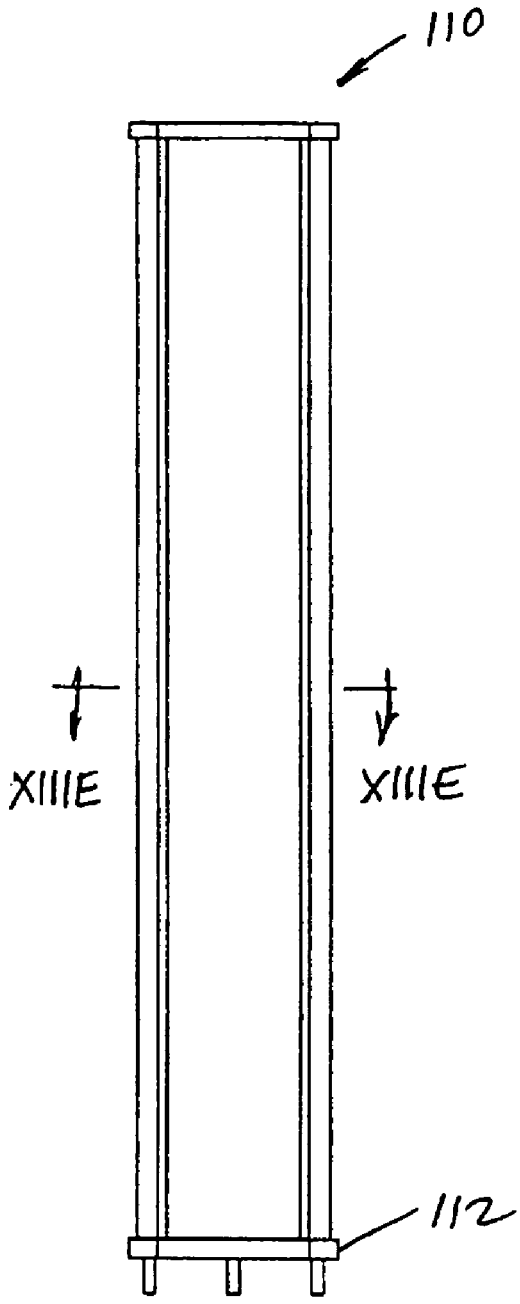
FIG. 9 is a front elevation view of the lighted post of FIG. 8.
Figure 12:
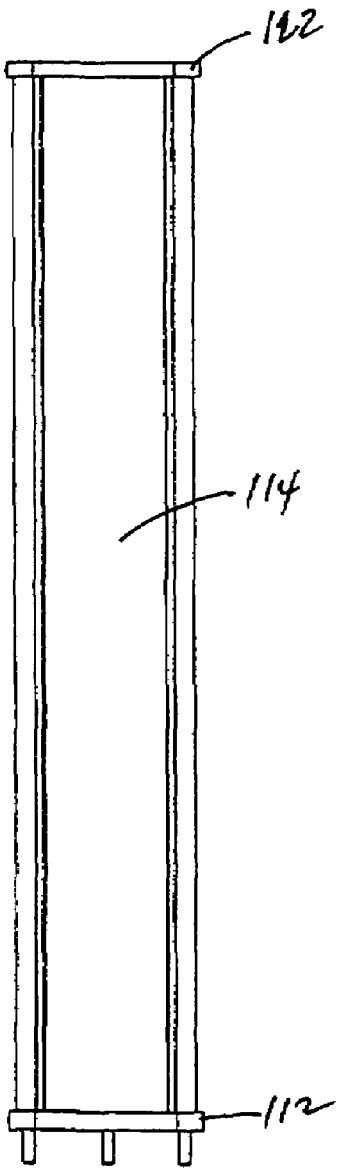
FIG. 12 is an elevation view of the left rear side of the lighted post of FIG. 9.
Figure 13:
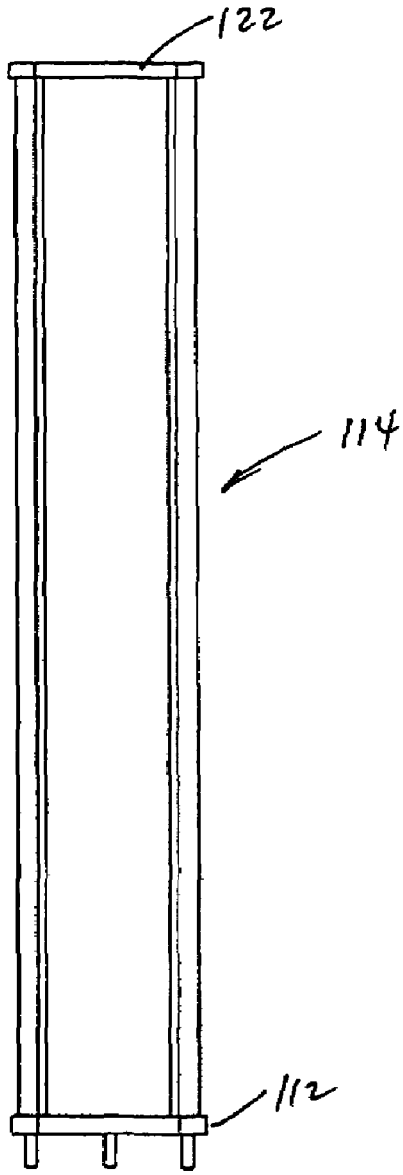
FIG. 13 is an elevation view of the right rear side of the lighted post of FIG. 9.
Figure 10:
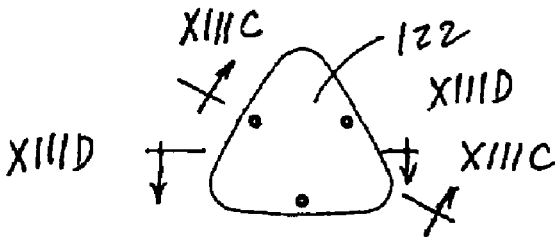
FIG. 10 is a top plan view of the lighted post of FIG. 9.
Figure 11:
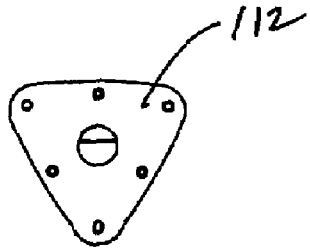
FIG. 11 is a bottom plan view of the lighted post of FIG. 9.
Figure 13A:
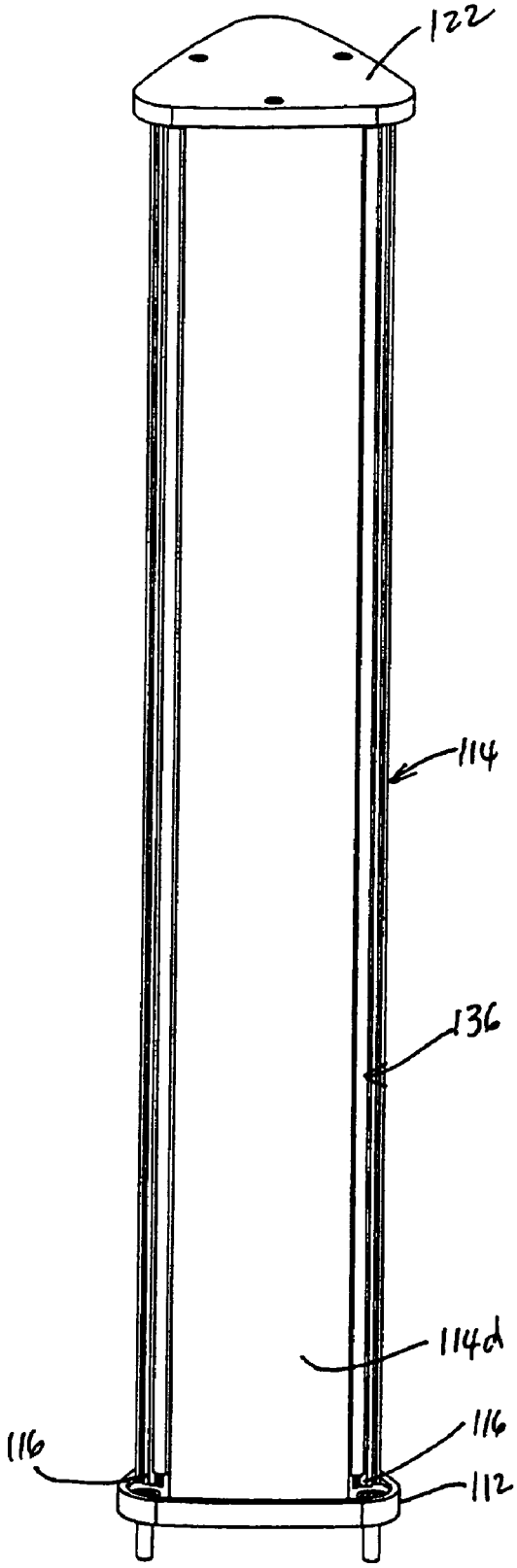
FIG. 13A is an elevation view of the lighted post of FIG. 9 with the light assembly covers removed.
Figure 13B:
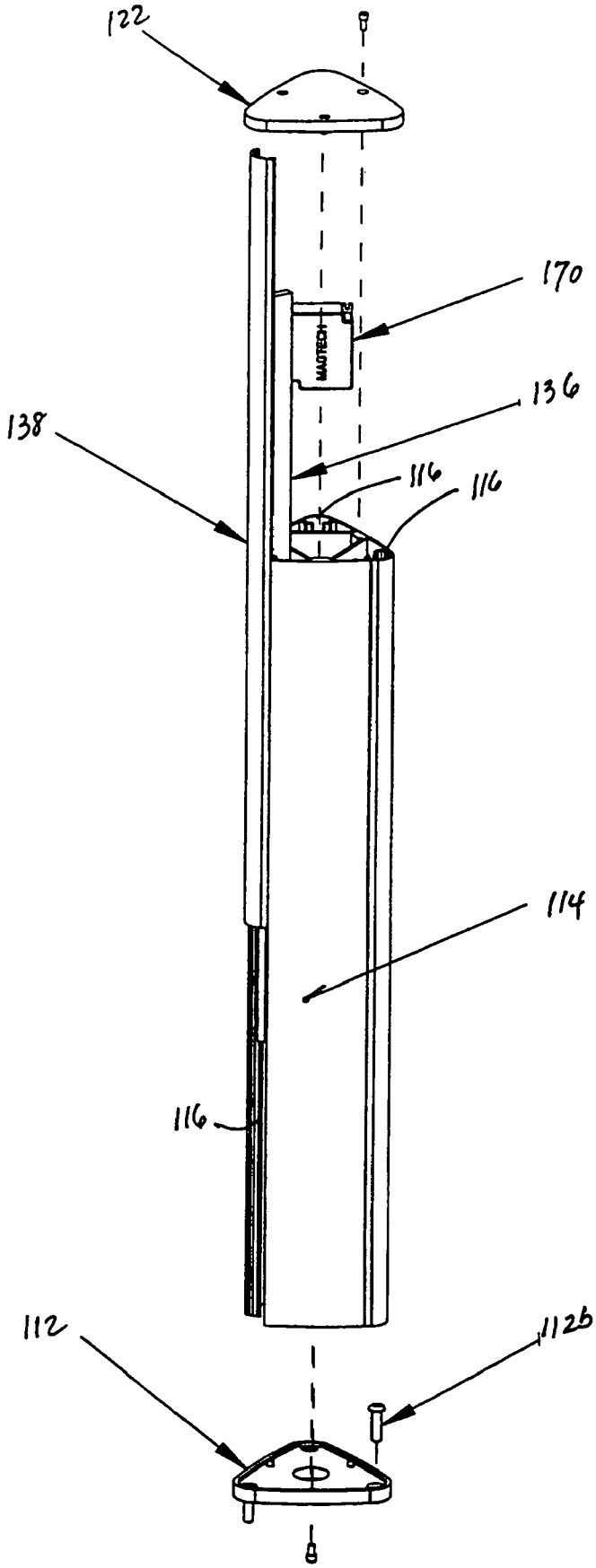
FIG. 13B is an exploded perspective view of the lighted post of FIG. 8.
Figure 13C:
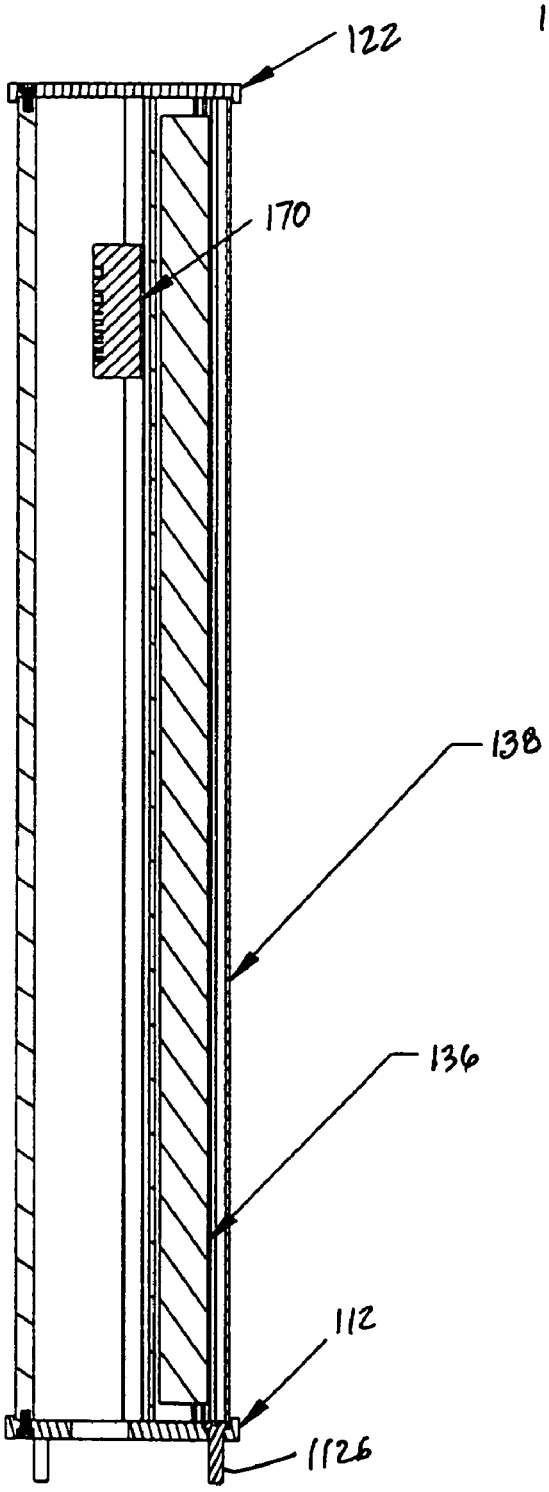
FIG. 13C is a cross-section taken along line XIIIC-XIIIC of FIG. 10.
Figure 13D:
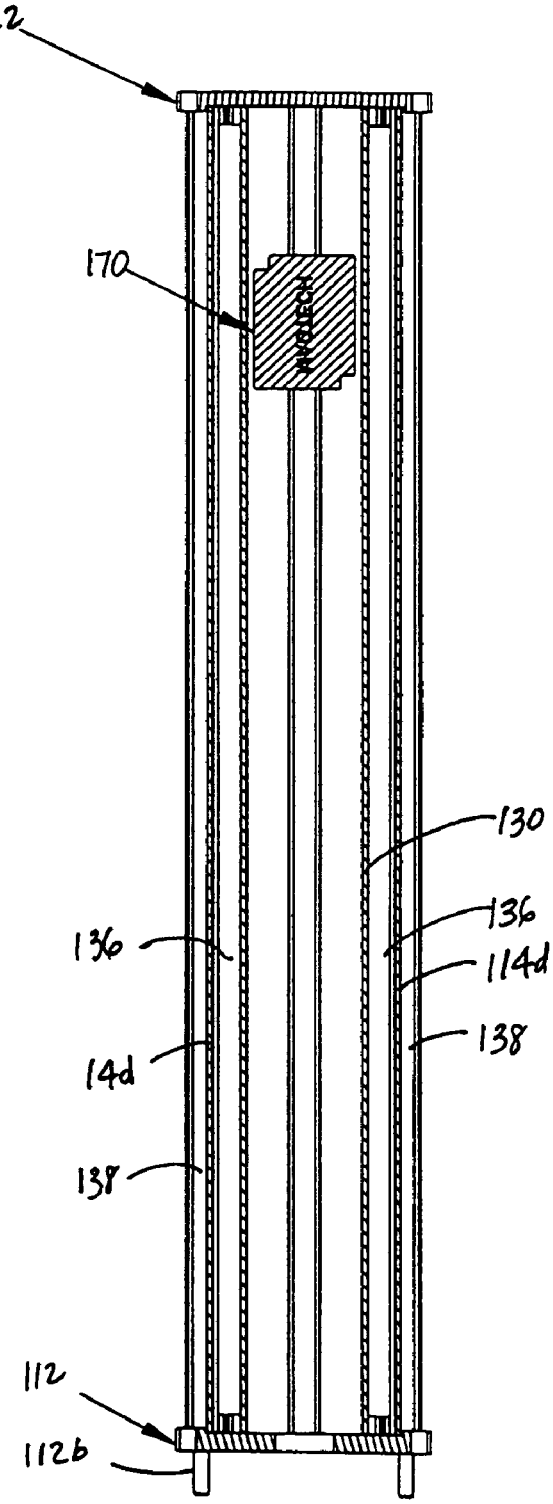
FIG. 13D is a cross-section taken along line XIIID-XIIID of FIG. 10.
Figure 13E:
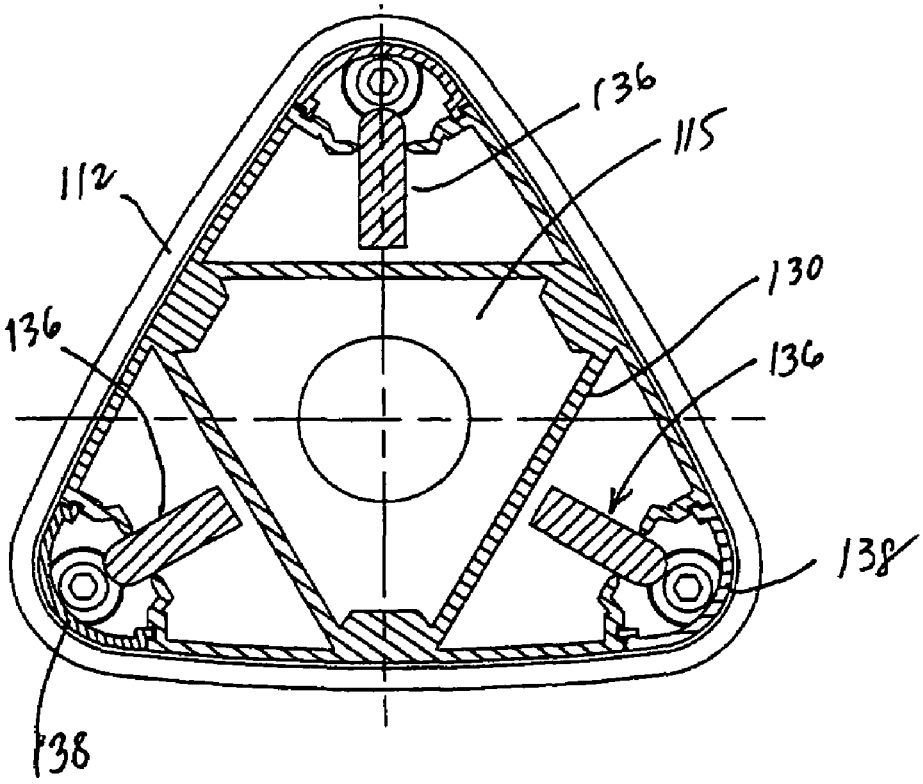
FIG. 13E is a cross-section taken along line XIIIE-XIIIE of FIG. 9.
Figure 13F:
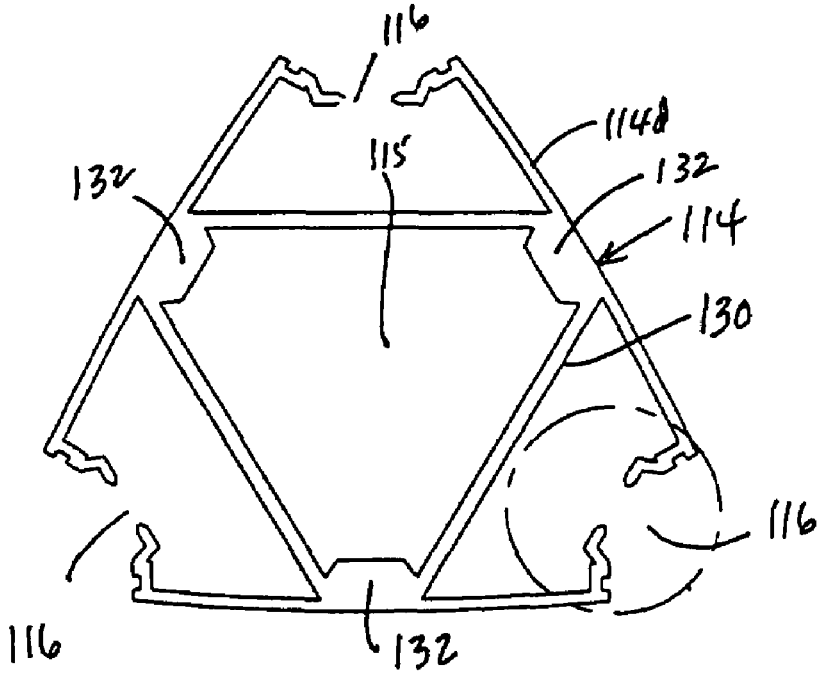
FIG. 13F is a top plan view of the lighted post of FIG. 9 with the support cover and light assemblies removed for clarity.
Figure 16:
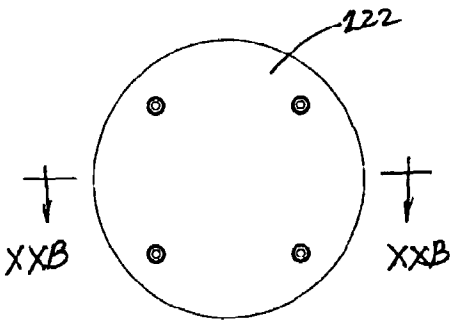
FIG. 16 is a top plan view of the lighted post of FIG. 15.
Figure 17:
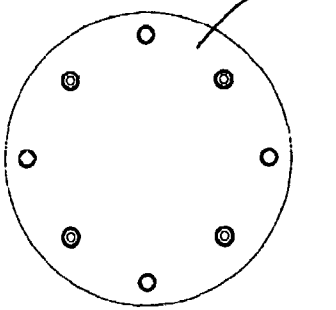
FIG. 17 is a bottom plan view of the lighted post of FIG. 15.
Figure 15:
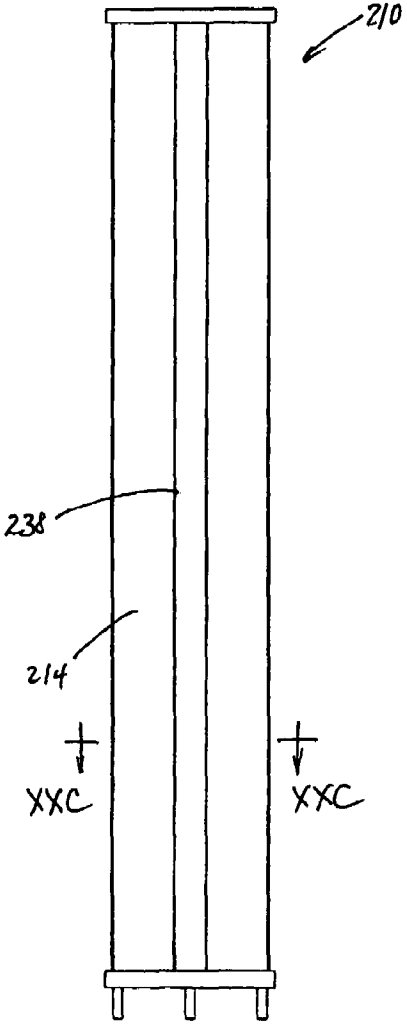
FIG. 15 is a front elevation view of the lighted post of FIG. 14.
Figure 14:
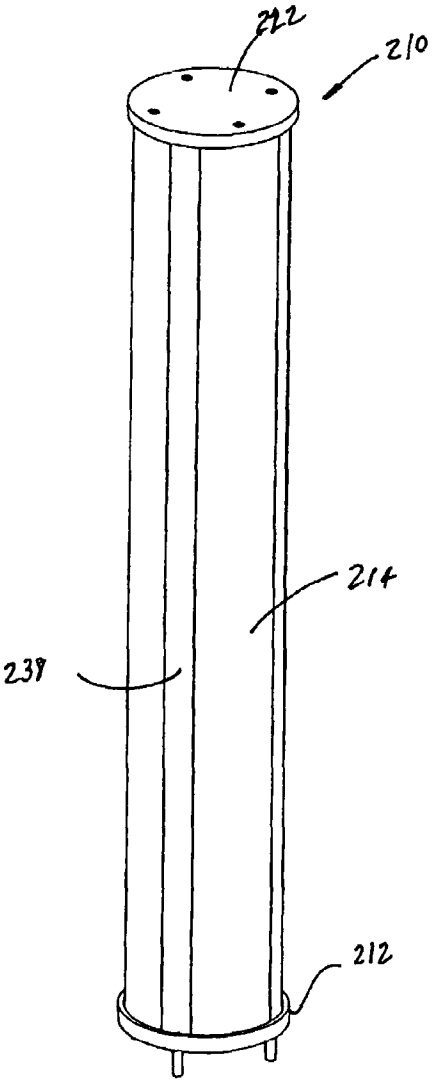
FIG. 14 is a perspective view of a third embodiment of the lighted post of the present invention.
Figure 20:
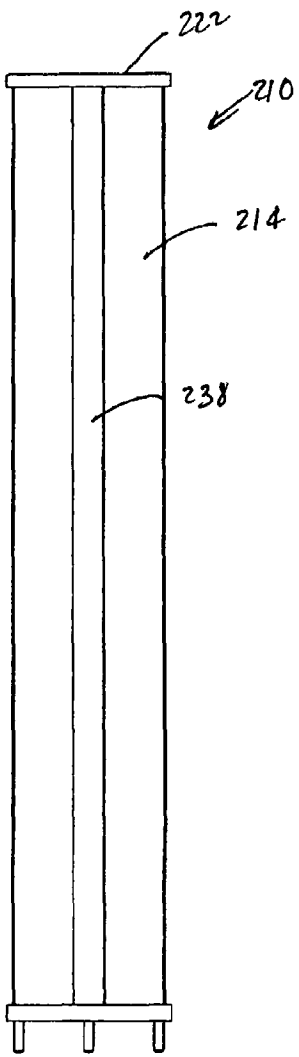
FIG. 20 is a rear elevation view of the lighted post in FIG. 15.
Figure 19:
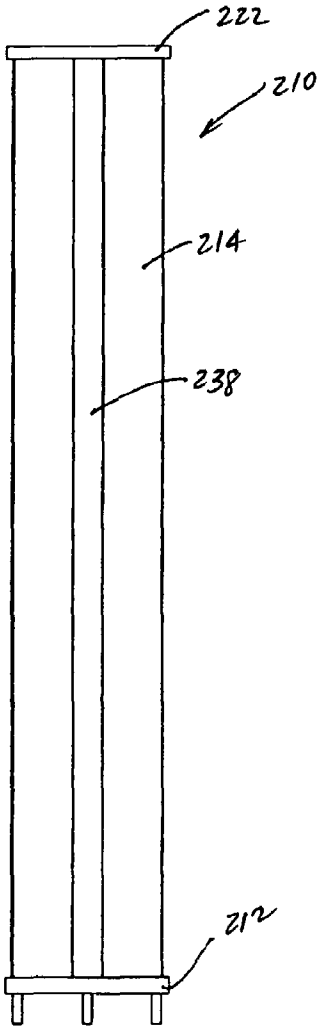
FIG. 19 is a right side elevation view of the lighted post of FIG. 15.
Figure 18:
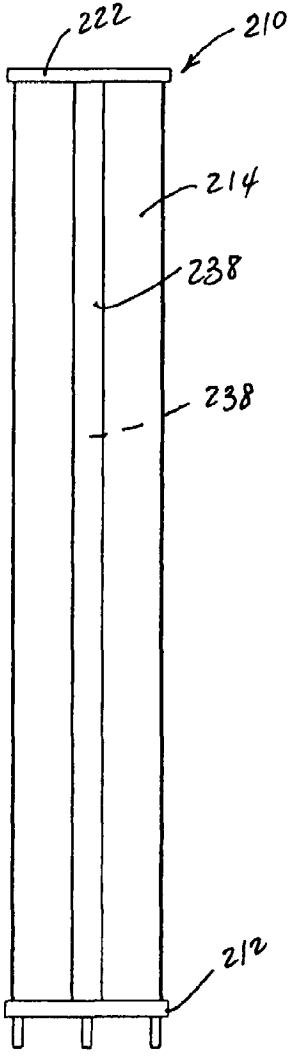
FIG. 18 is a left side elevation view of the lighted post of FIG. 15.
Figure 20A:
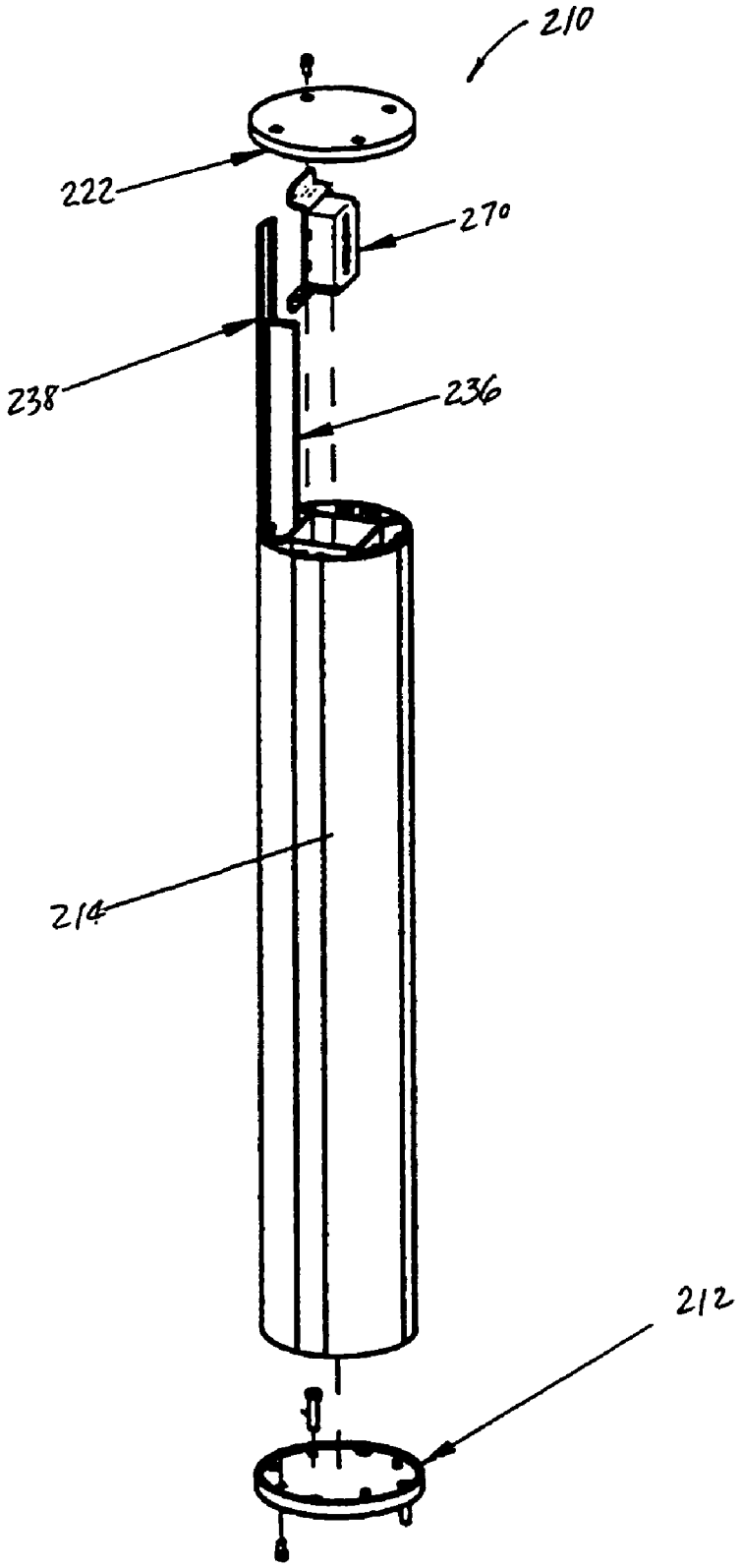
FIG. 20A is an exploded perspective view of the lighted post of FIG. 15.
Figure 20B:
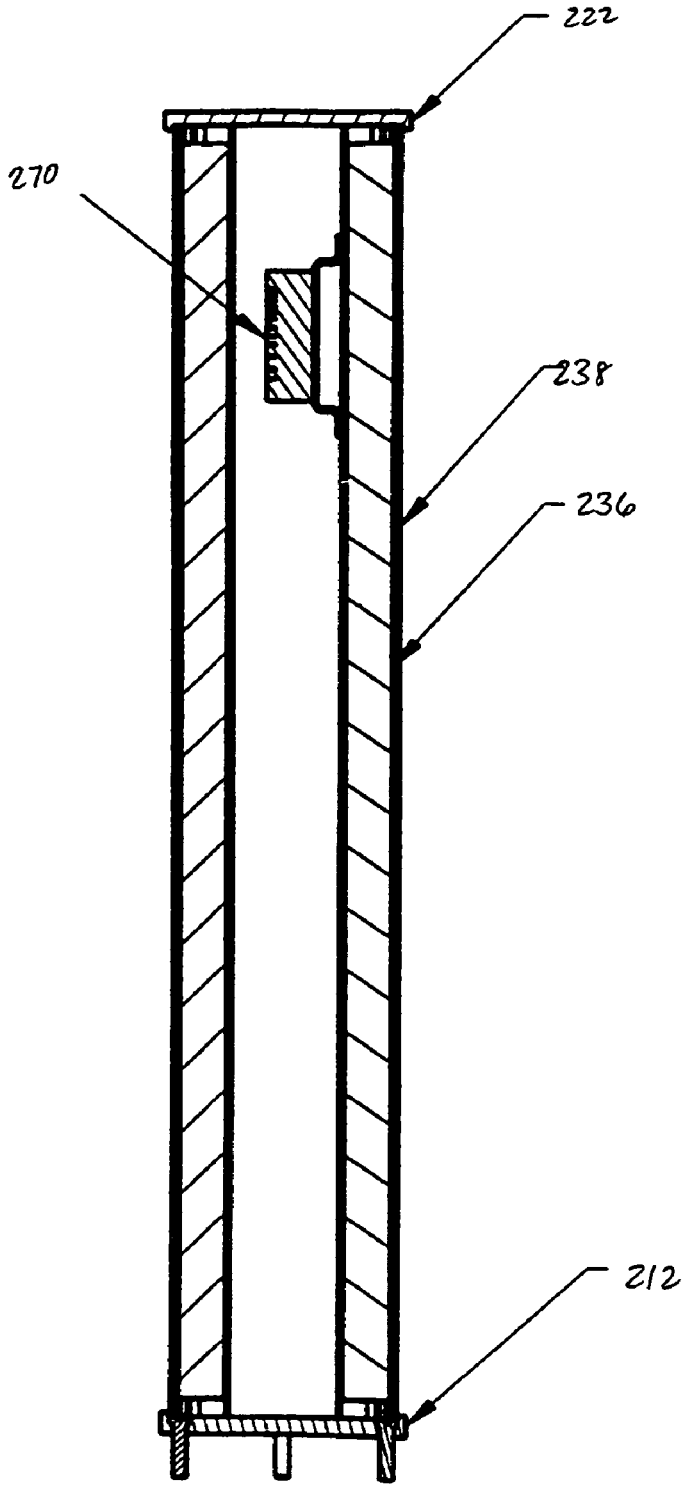
FIG. 20B is a cross-section taken along line XXB-XXB of FIG. 16.
Figure 20C:
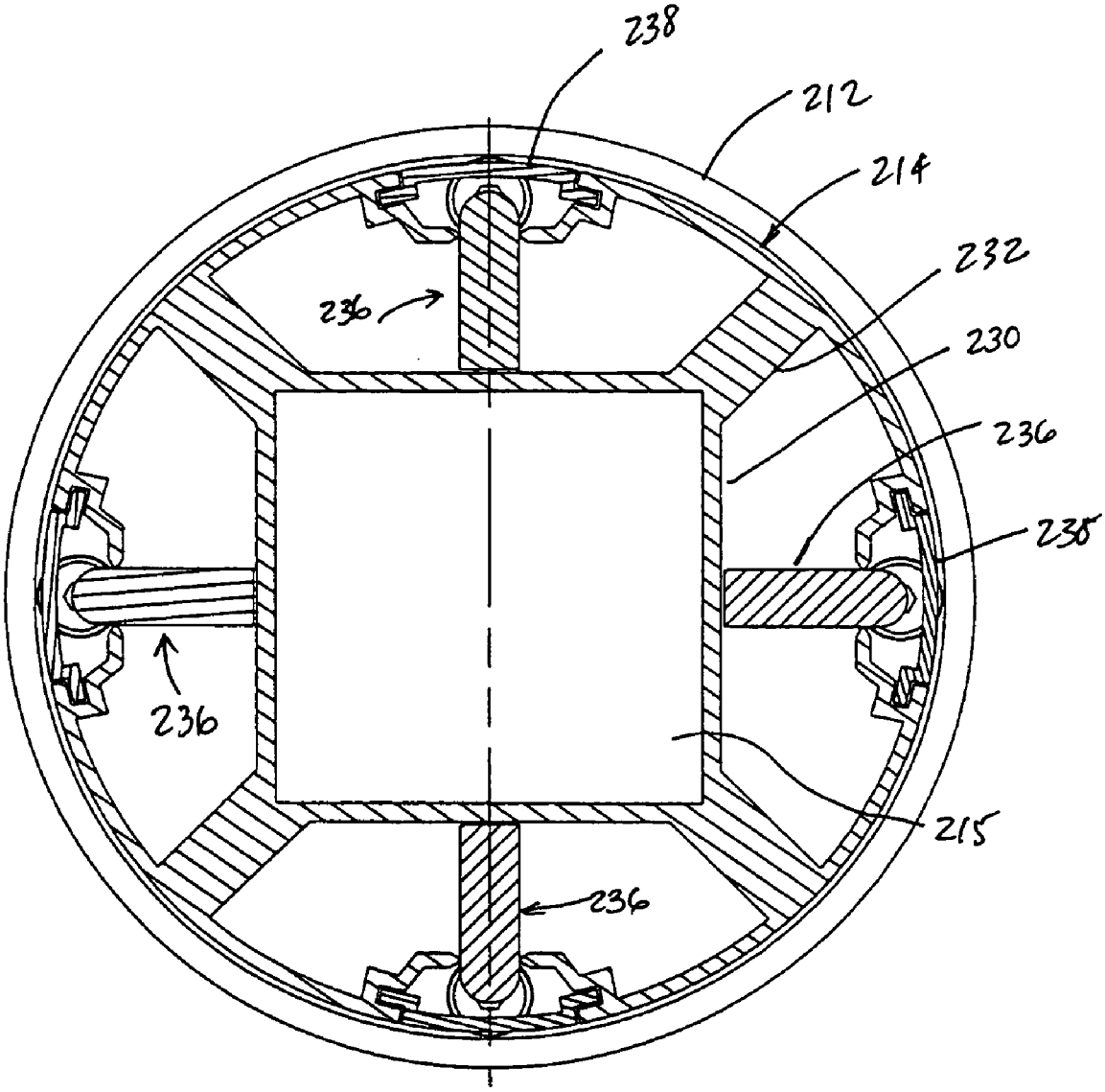
FIG. 20C is a cross-section taken along line XXC-XXC of FIG. 15.
Figure 20D:
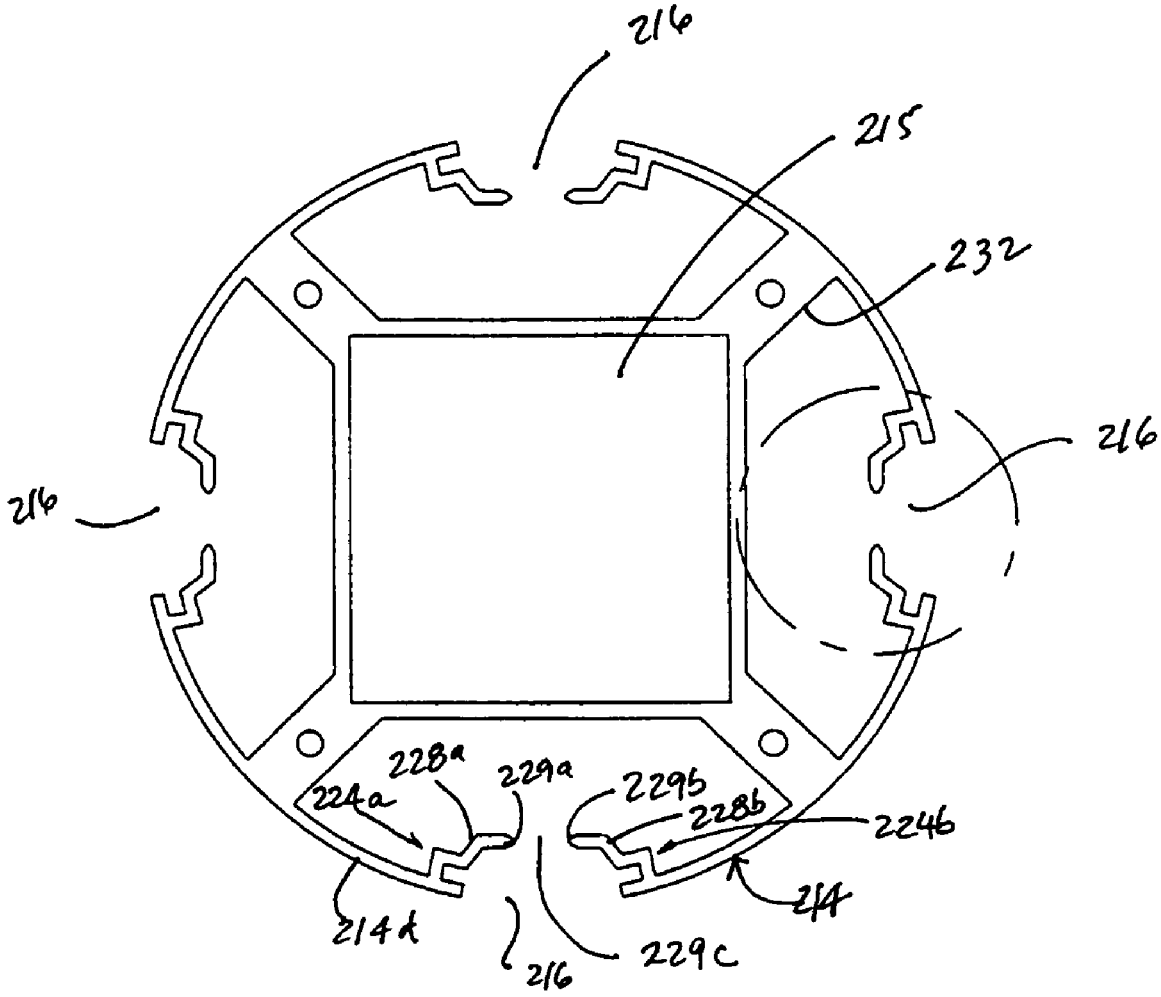
FIG. 20D is a top plan view of a lighted post of FIG. 15 with the support cover and light assemblies removed for clarity.
Figure 23:
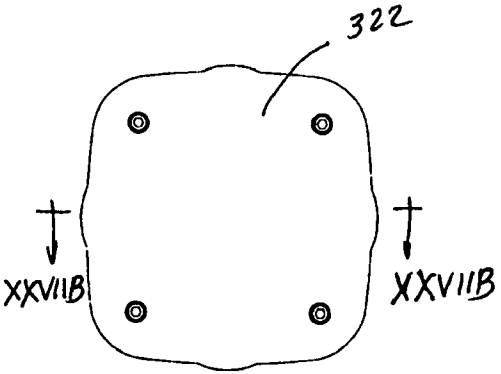
FIG. 23 is a top plan view of the lighted post of FIG. 22.
Figure 24:
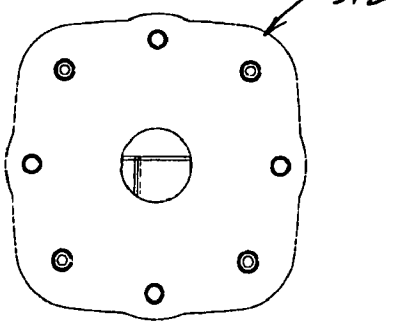
FIG. 24 is bottom plan view of the lighted post of FIG. 22.
Figure 22:
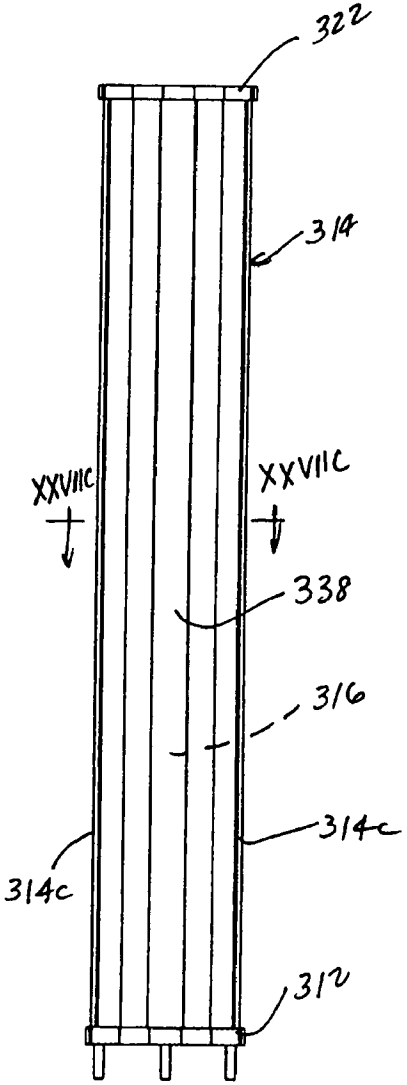
FIG. 22 is a front elevation view of the lighted post of FIG. 21.
Figure 21:
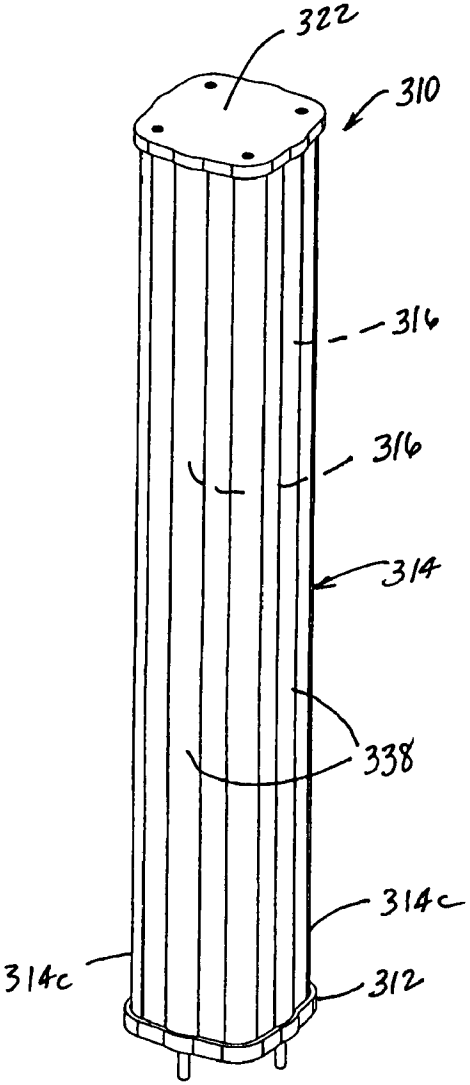
FIG. 21 is a perspective view of the another embodiment of the lighted post of the present invention.
Figure 26:
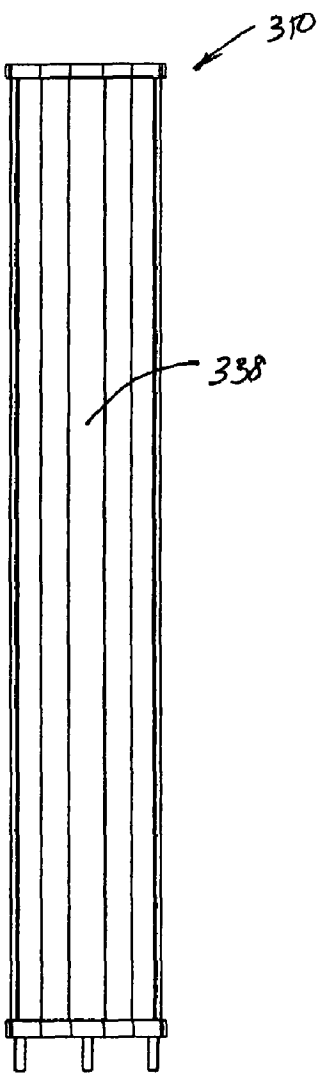
FIG. 26 is a right side elevation view of the lighted post of FIG. 22.
Figure 25:
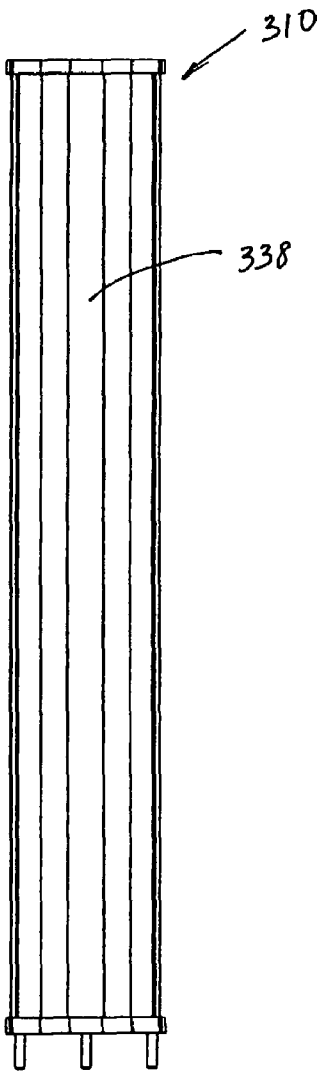
FIG. 25 is a left side elevation view of the lighted post of FIG. 22.
Figure 32A:
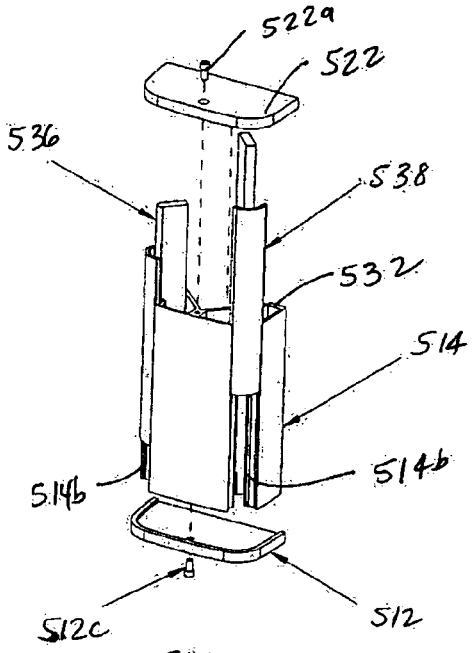
FIG. 32A is an exploded perspective view of the wall mounted version of the lighted assembly of FIG. 32.
Figure 32:
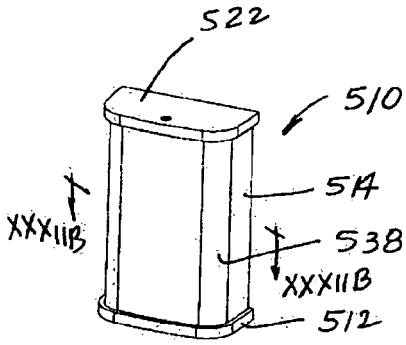
FIG. 32 is a perspective view of a wall mounted version of the lighted assembly of present invention.
Figure 33:
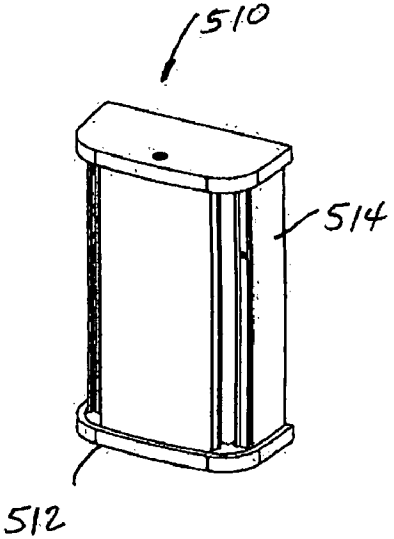
Figure 38:
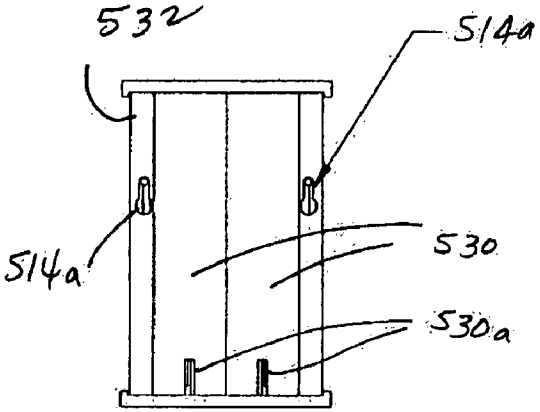
Figure 37:
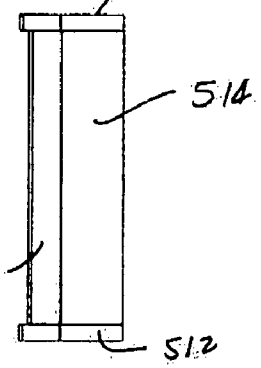
Figure 35:
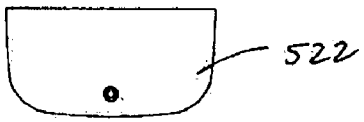
Figure 34:
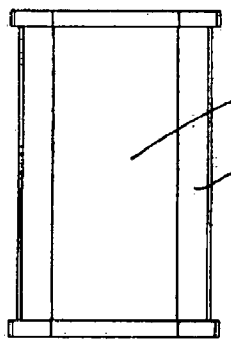
Figure 36:
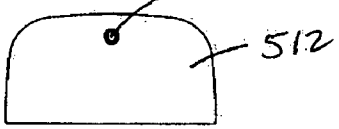
Figure 39:
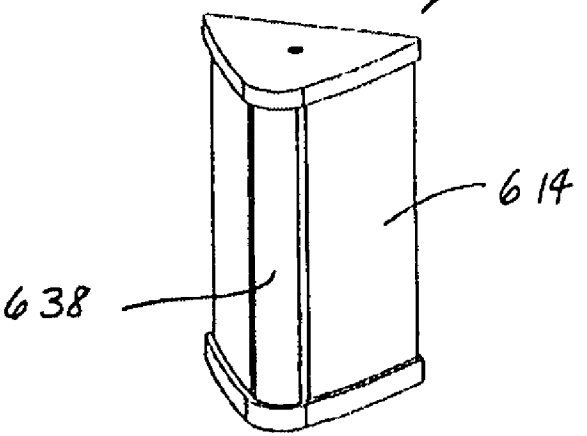
Figure 39A:
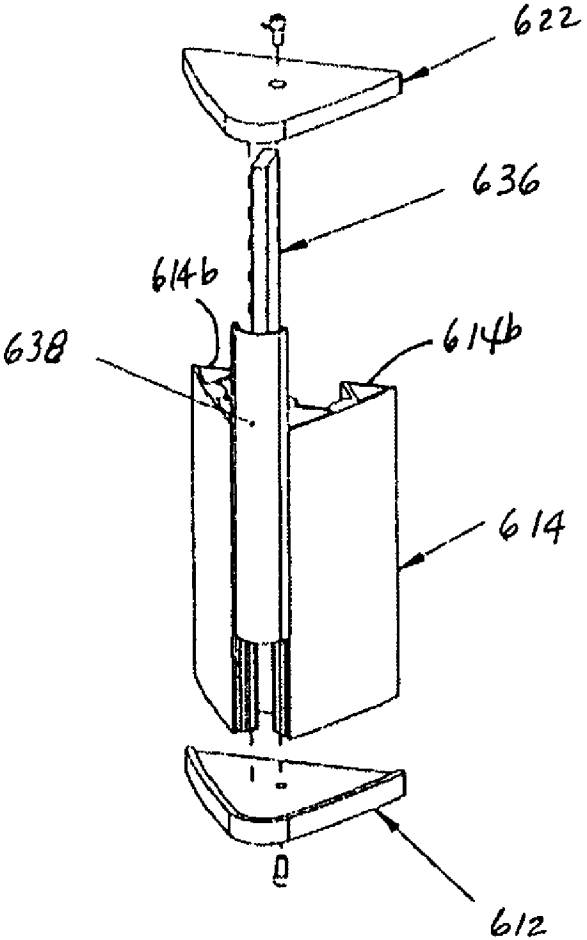
Figure 40:
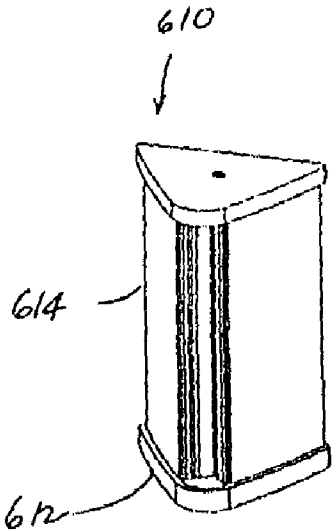
Figure 45:
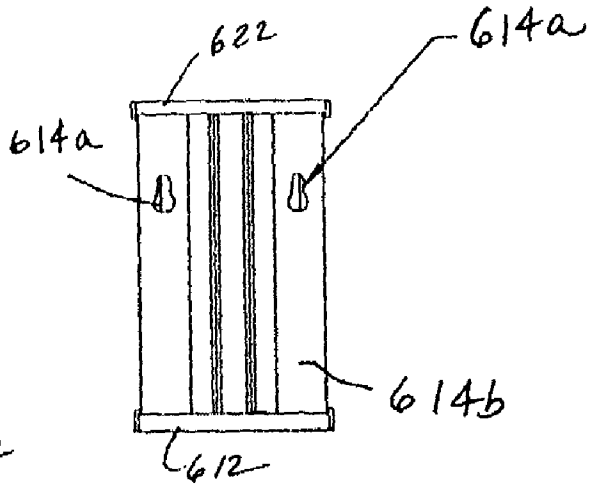
Figure 44:
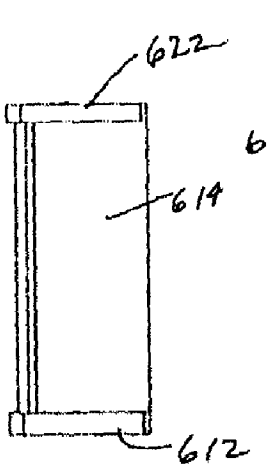
Figure 42:
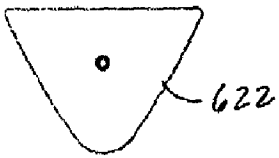
Figure 41:
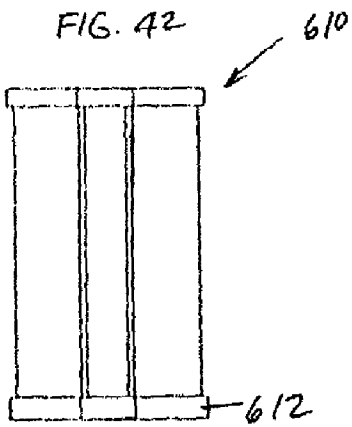
Figure 43:
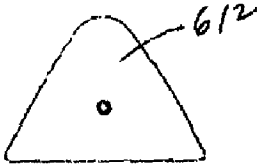
Figure 46:
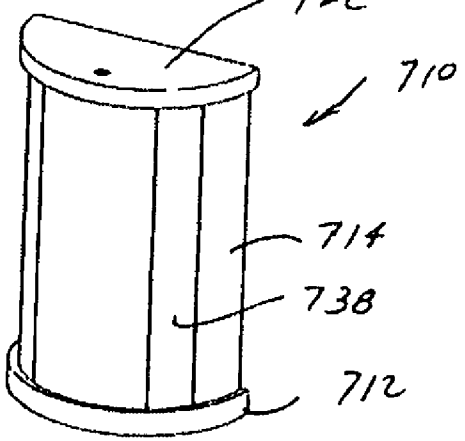
Figure 46A:
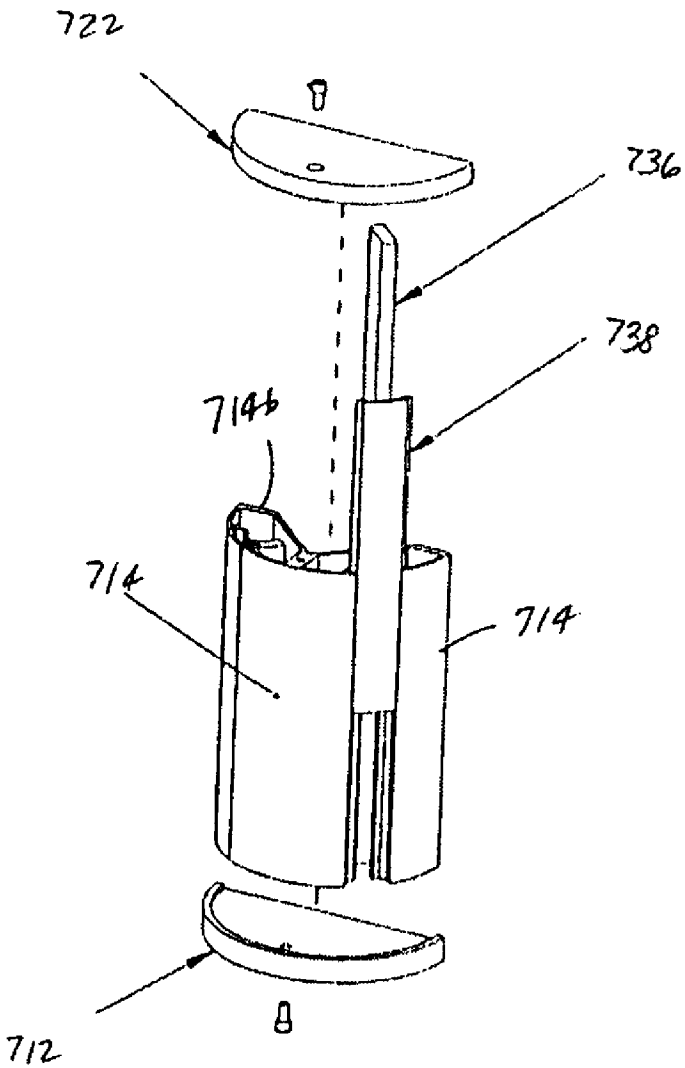
Figure 47:
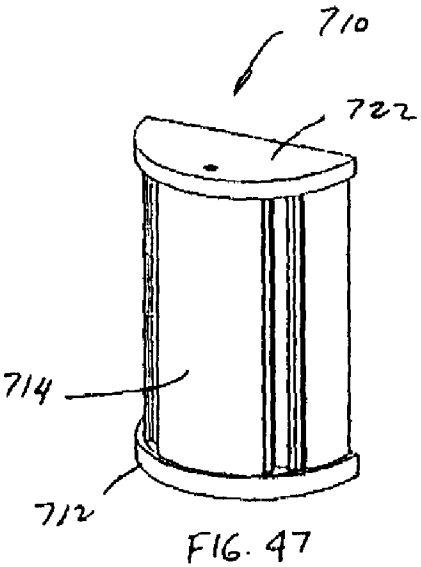
Figure 52:
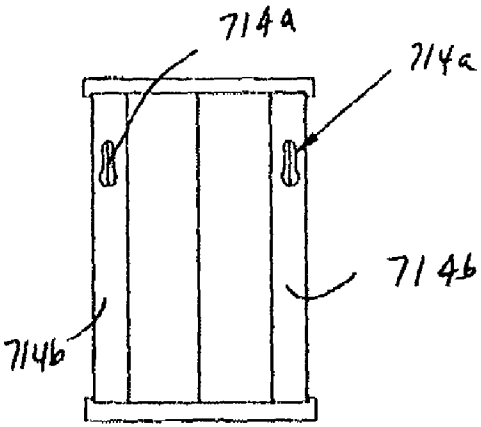
Figure 51:
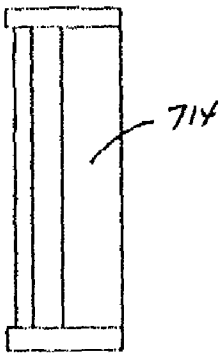
Figure 49:
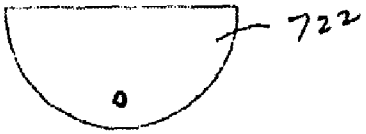
Figure 48:
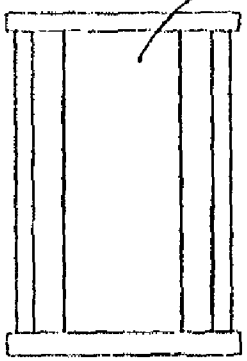
Figure 50:
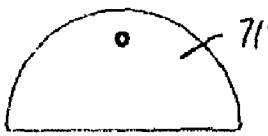
Figure 53:
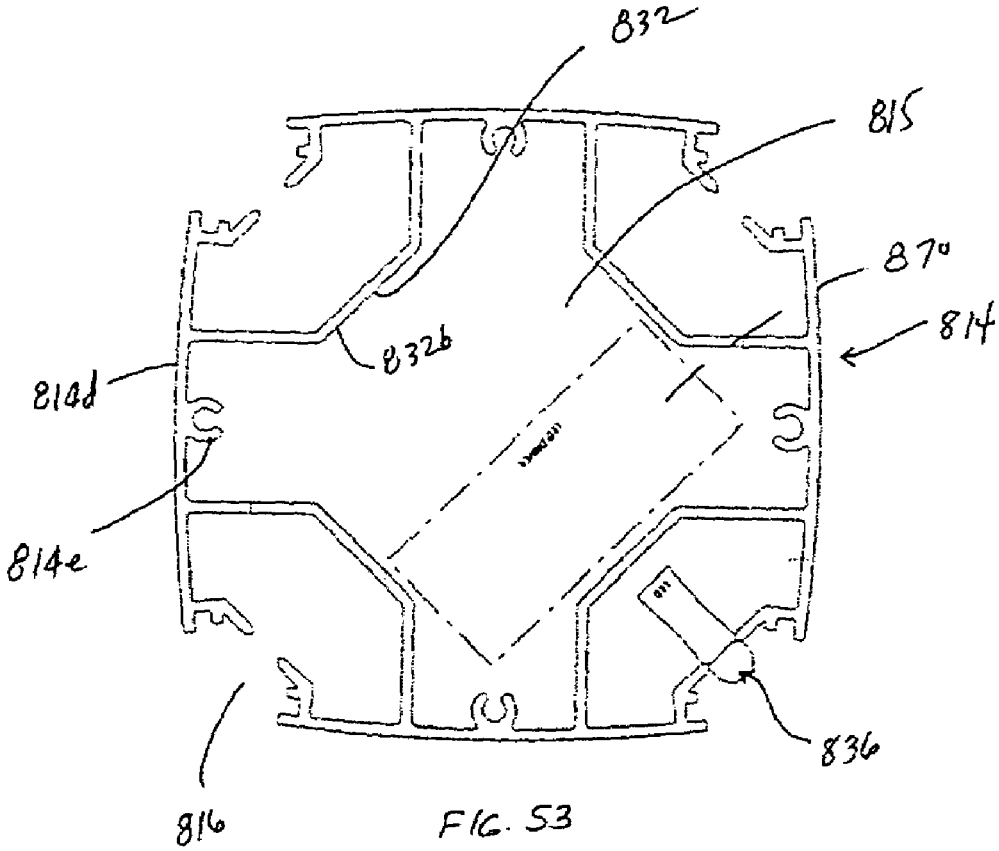
Figure 54:
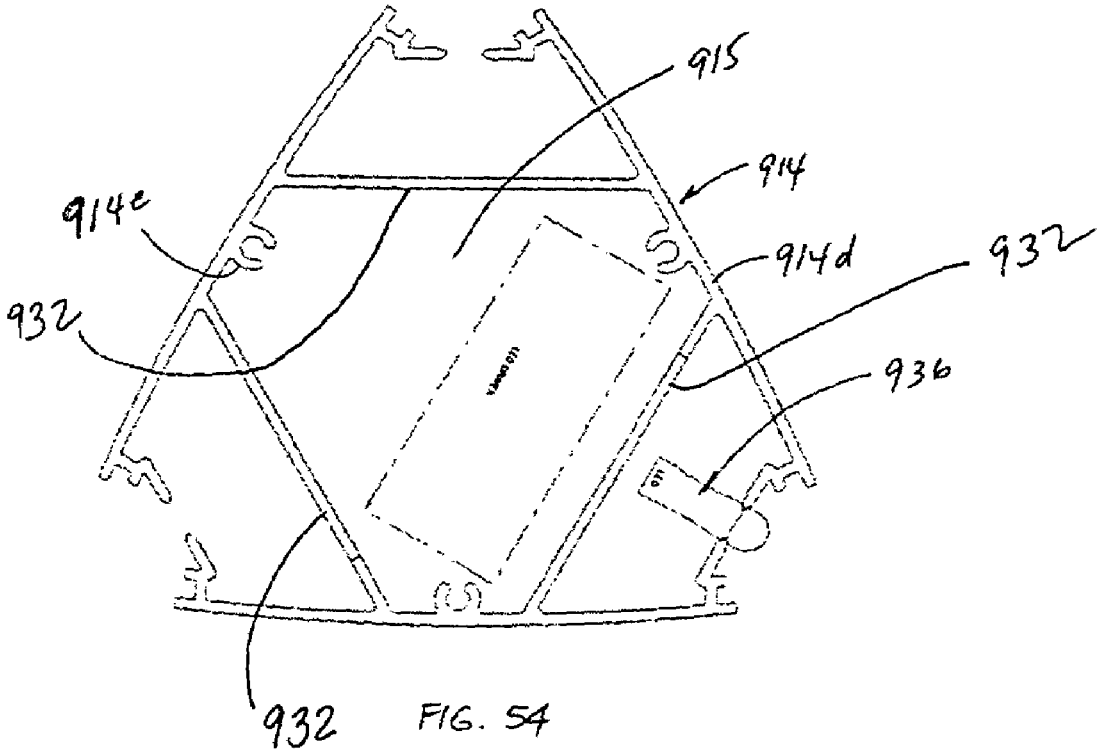
Figure 55:
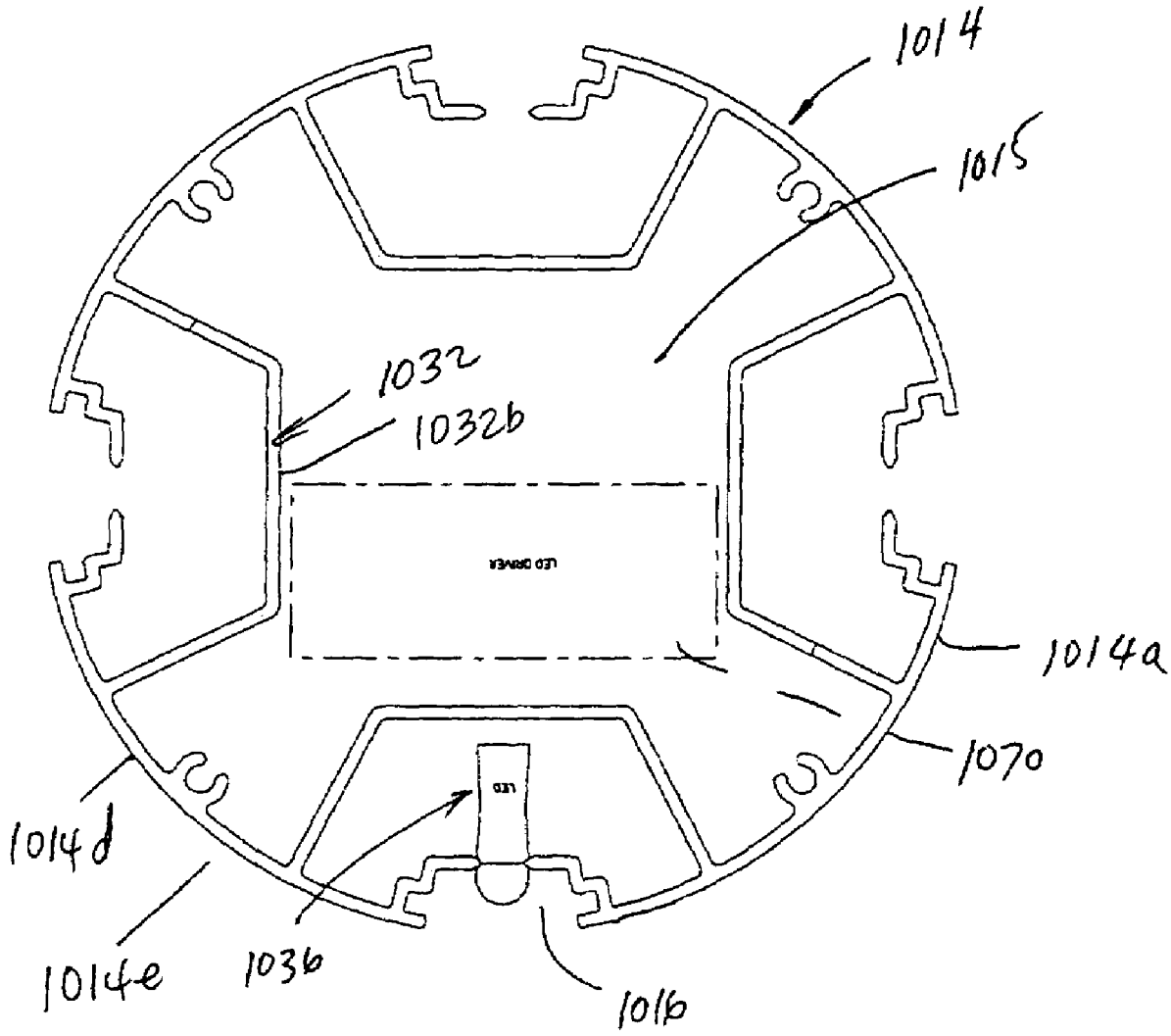
Figure 56B:
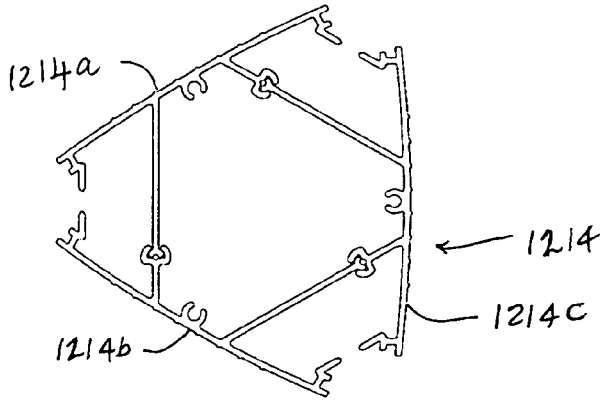
Figure 56C:
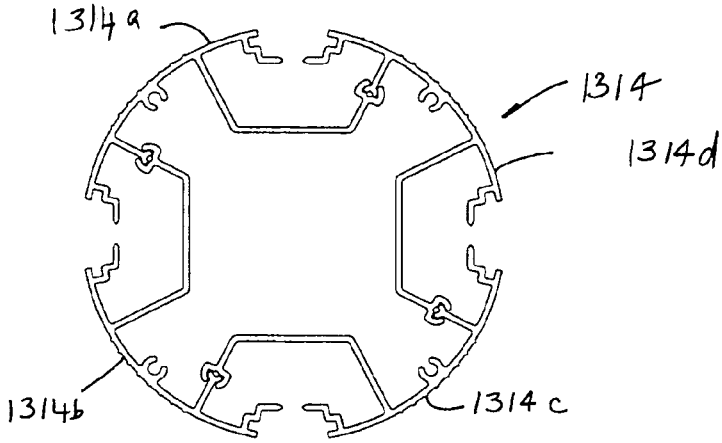
Figure 56A:
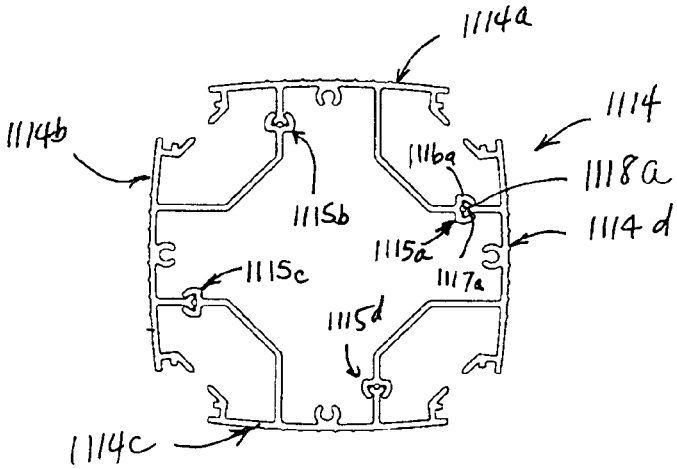

FIG. 33 a similar view to FIG. 32 with the light covers removed for clarity;

FIG. 34 is a front elevation view of the lighted assembly of FIG. 32;

FIG. 35 is a top plan view of the lighted assembly of FIG. 32;

FIG. 36 is bottom plan view of the lighted assembly of FIG. 32;

FIG. 37 is a right side elevation view of the lighted assembly of FIG. 32;

FIG. 38 is a rear elevation view of the lighted assembly of FIG. 32;

FIG. 39 is a perspective view of another wall mounted version of the lighted assembly of present invention;

FIG. 39A is an exploded perspective view of the wall mounted version of the lighted assembly of FIG. 39;

FIG. 40 a similar view to FIG. 39 with the light covers removed for clarity;

FIG. 41 is a front elevation view of the lighted assembly of FIG. 39;

FIG. 42 is a top plan view of the lighted assembly of FIG. 39;

FIG. 43 is bottom plan view of the lighted assembly of FIG. 39;

FIG. 44 is a right side elevation view of the lighted assembly of FIG. 39;

FIG. 45 is a rear elevation view of the lighted assembly of FIG. 39;

FIG. 46 is a perspective view of another wall mounted version of the lighted assembly of present invention;

FIG. 46A is an exploded perspective view of the wall mounted version of the lighted assembly of FIG. 46;

FIG. 47 a similar view to FIG. 46 with the light covers removed for clarity;

FIG. 48 is a front elevation view of the lighted assembly of FIG. 46;

FIG. 49 is a top plan view of the lighted assembly of FIG. 46;

FIG. 50 is bottom plan view of the lighted assembly of FIG. 46;

FIG. 51 is a right side elevation view of the lighted assembly of FIG. 46;

FIG. 52 is a rear elevation view of the lighted assembly of FIG. 46;

FIG. 53 is a similar view to FIG. 7E illustrating another embodiment of the cross-section of the square-shaped extruded member of the lighted post or assembly of the present invention;

FIG. 54 is a similar view to FIG. 13F illustrating another embodiment of the cross-section of the triangular-shaped extruded member of the lighted assembly of the present invention;

FIG. 55 is a similar view to FIG. 20D illustrating another embodiment of the cross-section of the circular-shaped extruded member of the lighted assembly of the present invention; and FIG. 56A-56C are similar views to FIGS. 53-55 illustrating the extruded members assembled from multiple extruded components.

DETAILED DESCRIPTION OF THE PREFERRED EMBODIMENTS

Figure 1:
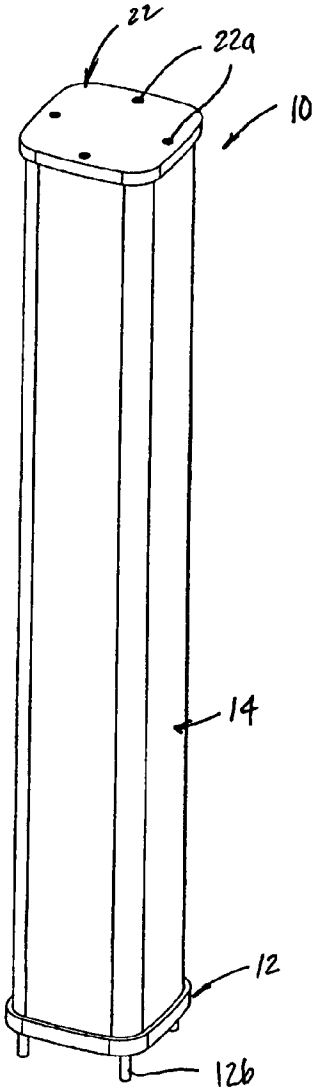
FIG. 1 is a perspective view of an extruded lighted post of the present invention.

Referring to FIG. 1, the numeral 10 generally designates a lighted assembly of the present invention in the form of a lighted post. As will be more fully described below, lighted post 10 is particularly useful as a lighted bollard and incorporates the use of light assemblies that use less energy and produce less heat than the lights used in conventional bollards and, further, in a manner to limit bug or dirt intrusion into the post to maintain the aesthetic appearance of the lighted post.

Figure 3:
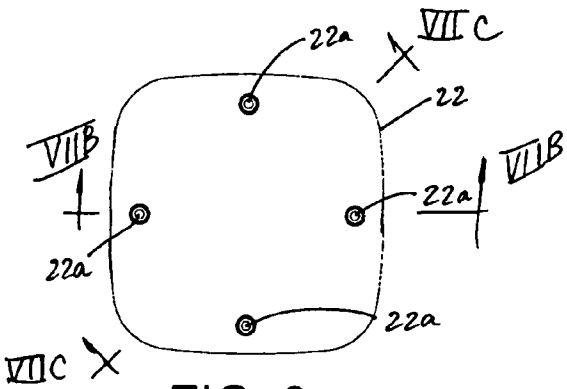
FIG. 3 is a top view of the lighted post of FIG. 1.
Figure 4:
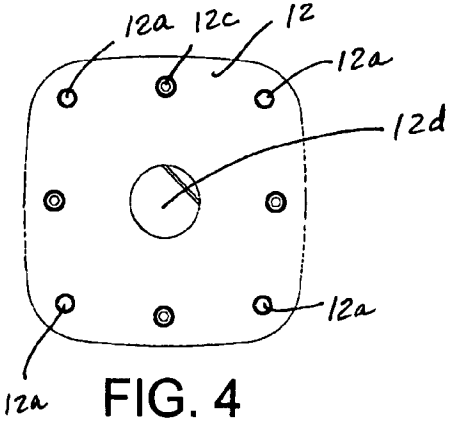
FIG. 4 is a bottom plan view of the lighted post of FIG. 1.
Figure 2:
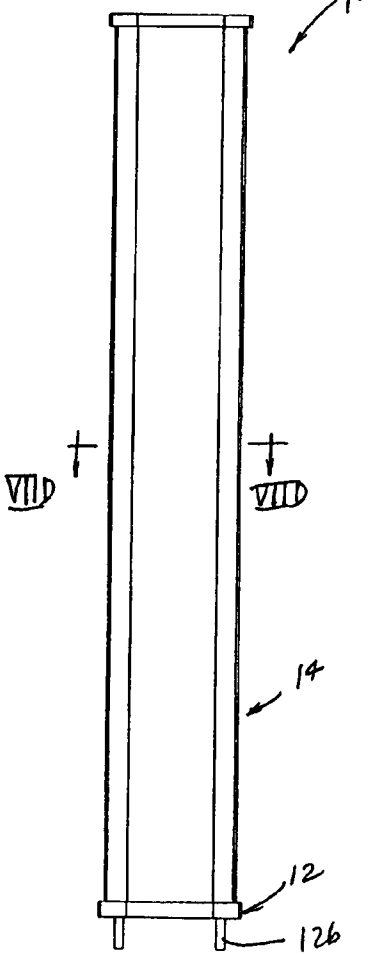
FIG. 2 is a front elevation view of the lighted post of FIG. 1.

In the illustrated embodiment, lighted post 10 includes a base 12 and a support 14 that is mounted to base 12 by fasteners 12*c* that extend from base 12 into lower end 14*b* of support 14. Base 12 is adapted to anchor support 14, for example, to a rigid support surface, such as the ground or to a mat, such as a concrete or asphalt pad, or to a deck. As best seen in FIG. 4, base 12 includes a plurality of mounting openings 12*a* for receiving anchor bolts 12*b* or the like to secure base 12 and, hence, support 14 to the rigid support surface as noted above to form a "bolt down" type post. However, it should be understood that support 14 may be mounted using other methods. For example, support 14 may be "cast in place". Alternately, a separate tubular member may be cast in the ground to form a sleeve into which support 14 is inserted to form a removable post.

Base 12 and support 14 are both preferably formed from a strong, rigid material, such as metal. However, it should be understood the base and support may be formed from plastic, such as a reinforced plastic, wood, or a composite material. In addition, in the illustrated embodiment, support 14 comprises a generally square-shaped support; however, as will be described below, the shape of the support, and also of the base and cover, may be varied.

As best seen in FIGS. 7A, 7D, and 7E, support 14 comprises a hollow member with one or more recesses 16 formed in the side wall of the support. The recess or recesses are provided for locating one or more light assemblies in the wall of the support. In preferred form, support 14 comprises an extruded aluminum hollow member that includes, in addition to one or more recesses 16 in the side wall of the support, a passageway 15 that extends through the support from upper end 14*a* of support 14 to lower end 14*b*. Further, recess or recesses 16 similarly extend from upper end 14*a* to lower end 14*b* so that support 14 includes upper open ends 18 and lower open ends 20, which are closed by base 12. Upper open ends 18 are closed and substantially sealed by a cover plate 22 to form enclosures for the light assemblies and a driver for the light assemblies described below.

Cover plate 22 is releasably secured to support 14, for example by fasteners 22*a*, so that cover plate 22 may be removed. Alternately, cover plate 22 may be fixedly secured to support 14, for example by welding or adhesive bonding or the like. In the illustrated embodiment, cover plate 22 comprises a flat generally square plate with rounded corners similar to base 12. It should be understood that the shape and size of the cover plate or base may be varied.

Support 14 includes at least one recess 16 and, more preferably, a recess 16 at each of its corners 14*c*. In the illustrated embodiment, support 14 comprises a generally square-shaped hollow member with four sides, with the recesses formed at the intersections of the sides at each of the four corners 14*c*. Recesses 16, as previously noted, extend along the full longitudinal length of support 14 and further are substantially parallel and generally commensurate in width with each other—though it should be understood that their widths may vary.

As best seen in FIGS. 7D and 7E, recesses 16 are formed in the side walls 14*d* of support 14 and are defined between the terminal edges 14*e* of side walls 14*d* and web walls 24*a* and 24*b* that extend inwardly from side walls 14*d* preferably over the full longitudinal length of support 14. Web walls 24*a* and 24*b* have mirror images with each web wall 24*a*, 24*b* having base portion 25*a*, 25*b* that is generally orthogonal to side wall 14*d* and an intermediate portion 26*a*, 26*b* that is generally parallel to and inwardly offset from base portion 25*a*, 25*b* to form a slot 27*a*, 27*b* with terminal edges 14*e* of side wall for receiving a light assembly cover, as will be more fully described below.

Extending inwardly from intermediate portions 26*a*, 26*b* are angled end portions 28*a*, 28*b*, which are angled toward each other so that they are aligned in a common plane. The distal edges 29*a*, 29*b* of angled end portions 28*a*, 28*b* are spaced apart to define a longitudinal slot 29*c* into which a light assembly is mounted, which is more fully described below in reference to FIG. 7D.

In addition, side walls 14*d* are interconnected by a central tubular-shaped member 30 that connects to the medial portions of the side walls by web walls 32. Tubular-shaped member 30 extends through the full length of support and forms central passageway 15 through support 14 in which the wiring and/or controls for the light assemblies may be housed and directed for coupling to an internal driver, such as driver 70, or to an external driver or controls.

In preferred form, as noted, support 14 is formed from an extruded aluminum member and, optionally, anodized. In this manner, support 14 can be formed and cut to suit at any length, which can greatly facilitate the manufacturing process from a cost perspective and an inventory perspective. However, it should be understood that support 14 may be formed from a plastic, including a reinforced plastic.

Referring to FIG. 7D, at least one light assembly 36 is located at each recess 16. Optionally, more than one light assembly may be located in each recess. For example, adjacent light assemblies may be positioned side-by-side or may be stacked in the respective recesses. Multiple light assemblies may be used to form different patterns of light or provide different colors of light or the like. In addition, each light assembly 36 is optionally enclosed in the recess 16 and in support 14 by a cover 38 that engages side walls 14*d* of support 14. For example, each cover 38 may engage sidewalls 14*d* of support 14 with the free edges 38*a* and 38*b* of its longitudinal flanges inserted into the elongate slots 27*a*, 27*b* formed by the web walls 24*a*, 24*b* and terminal edges 14*e* of side walls 14*d*. Seals may be located in or extruded into slots 27*a*, 27*b*. For example, a seal material may be formed in slots 27*a*, 27*b* with support 14 by rolltrusion.

As would be understood, covers 38 preferably comprise a light transmitting material that is impact resistant and may be formed from a number of suitable plastics, including Plexiglas or the like. Further, covers 38 may be adapted, such as by tinting, to form diffusers to further diffuse the light emitted from the light assemblies. In addition, covers 38 may be tinted with a color to produce colored light. It should be understood that in some applications covers 38 may also be formed or provided with optical surfaces or structures to form a desired light pattern.

Referring again to FIG. 7D, each light assembly 36 is formed from a plurality of light sources 40 and preferably a string of light sources, such as a string of light emitting diodes (LEDs) and, more preferably, a string of high intensity light emitting diodes that are contiguously mounted, for example, to circuit board 40*a*. The LEDs may produce a white light or may produce colored light, such as blue, yellow, or provide different levels of colors of white light. In addition, each light assembly 36 includes an elongate body 42 that is configured to act as a wave guide, which scatters the light emitted by the light sources along its length but allows the light to exit through its lateral surface. For example, in the illustrated embodiment, elongate body 42 extends along substantially the full length of its respective recess to provide light along substantially the full longitudinal length of post 10.

The light sources (40) are enclosed in a housing 44 that is positioned adjacent the wave guide and directs the light into the wave guide. Housing 44 also houses the electrical wiring 40*b* and circuit board 40*a* for the LEDs. Suitable light assemblies are available under the trade name PLEXINEON from iLight Technologies, Inc. of Illinois. For further details of suitable light assemblies, reference is made herein to U.S. Pat. No. 6,592,238, which is incorporated by reference herein in its entirety.

Referring again to FIG. 7D, wave guide 42 includes a curved outer surface 46 that forms a light emitting surface 48. When each light assembly 36 is mounted in a recess 16, body 42 is positioned in the recess and, further, in longitudinal slot 29*c*. Distal edges 29*a*, 29*b* of angled portions 28*a* and 28*b* are preferably tapered to engage body 42, for example, so that the light assembly is held in recess 16. In addition, light assemblies 36 are positioned so that their light emitting surfaces 48 are oriented to face outwardly from recesses 16 to direct light outwardly from support 14. In the illustrated embodiment, light emitting surfaces 48 are slightly recessed within recesses 16 so that they can be covered by covers 38, which in the illustrated embodiment follow the outer perimeter of support 16—in other words, covers 38 provide a continuous outer surface for support 14 that is flush and contiguous with the outer surfaces of side walls 14*d*. However, it will be appreciated that light emitting surfaces 48 may be flush or project from recesses 16, in which case covers 38 could likewise project outwardly beyond the outer perimeter of support 14.

Because the outer surfaces (46) of the wave guides (42) are curved, the light emitted from each respective light assembly is fanned outwardly, such as illustrated in FIG. 7 of U.S. Pat. No. 6,592,238, referenced above. Though the LEDs tend to produce directional light, the wave guide will distribute the light from the LEDs in a manner to simulate a neon light. However, the light assemblies of the present invention produce much less heat than a neon light or other conventional lights, which as will be more fully described below, allows the light assemblies to be positioned such that their light emitting surfaces may be at or adjacent (or project from) an exterior surface of the light post without the risk of injury to a passerby. Further, as described, light assemblies 36 are enclosed by covers 38 and the open ends of support 14 are closed by cover plate 22 and substantially closed by base 12 so that the post may be essentially closed and sealed to eliminate bug or dirt intrusion into support 14, which will allow the post to remain clean and maintain its aesthetic appearance.

Referring again to FIG. 7D, light assemblies 36 are mounted in recesses 16 in longitudinal slots 29*c*. Slots 29*c* are sized to receive the respective light assemblies and, further, so that the spaced lateral edges 29*a*, 29*b* of the web walls 24*a*, 24*b* engage the light assemblies. Optionally, each light assembly 36 includes an elongate groove 58 along its lateral sides 60 and 62, into which lateral edges 29*a*, 29*b* extend to thereby engage the respective light assembly.

Referring to FIGS. 7D and 7E, tubular-shaped member 30 includes one or more transverse openings 64, which allow the wiring from the respective light assemblies to be directed into passageway 15. For example, housed in passageway 15 may be a driver or transformer 70 for reducing a supply voltage to a drive voltage that is suitable for driving the LEDs in light assemblies 36. Driver 70 may be mounted in tubular-shaped member 30 by a bracket 72 (FIGS. 7A-7C). Accordingly, the various wiring 74 from the light assemblies 36 are extended into passageway 15 through openings 64 for coupling to the driver or transformer, which in turn, includes wiring 70*a* that extends through an opening 12*d* (FIG. 4) provided in base 12 for connecting to an external power supply, which is external to support 14. Optionally, the transformer may also be mounted externally of support 14.

Accordingly, lighted post 10 may be assembled by inserting the respective light assemblies into one of the open ends (18, 20) of support 14 and into slots 29*c* to guide the light assemblies into the recesses. After inserting the light assemblies, wiring 74 may be directed through openings 64 for hook up to the driver or transformer, which as noted may be mounted in tubular-shaped member 30, whose wiring 70*a* is extended from support 14 through base 12. After the wiring is hooked up, cover plate 22 may then be installed by fasteners 22*a*, which engage threaded openings 32*a* formed in webs 32 (FIG. 7E). To assemble post 10, fasteners 12*b* are located in openings 12*a* of base 12 and base 12 is secured to support 14. Base 12 is secured to support by fasteners 12*c* that thread into openings 32*b* (FIG. 7B) formed in the lower ends of webs 32 of support 14. Once base 12 is mounted to support 14, wiring 70*a* of driver 70 is extended through support 14 and then cover 22 is secured to support 14 by fasteners 22*a* that similarly engage support 14 by threading into bosses provided at the upper ends of webs 32.

Thus, when assembled, lighted post 10 provides a substantially sealed lighted post that is suitable for use as a security bollard or simply as a decorative bollard, or for pathway, directional, or signal lighting. Furthermore, the voltage and current requirements to drive the light assemblies within the lighted post are relatively low and, therefore, consume less power than conventional lighted posts. In addition, by incorporating LED light sources into the light assemblies, the heat produced by the light assemblies are significantly reduced over neon, halogen, metal halide, high pressure sodium, fluorescent, and incandescent lights or the like and, further, provide an extended life. For example, high intensity LED's may have a life expectancy on the order of 180,000 hours. Consequently, the light assemblies may be left on for extended periods of time. In addition, given the expected life expectancy of the light assemblies, the lighted post may be assembled in a manner so that the light assemblies are permanently mounted or embedded in the tubular member.

Optionally, lighted post 10 may incorporate a sensor that detects, for example, motion or light, for example, a low light condition, which triggers actuation of the light assemblies. For example, tubular-shaped member 30 may house control circuitry and/or electronics that are coupled to the light assemblies and to the sensor and responds to the sensor detecting motion or a low light condition by powering the light assemblies.

In addition, given the extruded nature of the support, the lighted assembly may be configured as a wall-mounted lighted assembly, such as described in reference to FIG. 32 below. Further, the cross-section of the extruded member may be varied or modified to accommodate additional features or to provide additional functions, such as described in reference to FIGS. 53-55 below.

As noted previously, the shape of the support 14 may be varied. For example, referring to FIGS. 8-13, 13A-13E, the numeral 110 designates yet another embodiment of the lighted post of the present invention. Lighted post 110 is of similar construction to lighted post 10 but includes a triangular-shaped support 114 that is mounted to a triangular-shaped base 112, which mounts to a fixed surface by fasteners 112*b*, and is closed by a triangular-shaped cover 122. Support 114 similarly comprises a hollow support formed from an extruded aluminum member with a plurality of recesses 116 formed in the corners 114*c* of support 114. Though it should be understood that support 114 may be formed from other materials, including plastic.

In the illustrated embodiment, post 110 includes three light assemblies 136 mounted at a respective corner 114*c* of support 114 in a similar manner described in reference to the previous embodiments. Light assemblies 136 are of similar construction to light assemblies 36 and are driven by a driver 170 (FIGS. 13C, 13D) mounted in support 114; therefore, for further details for light assemblies 136, driver 170, and the mounting of light assemblies 136, reference is made to the previous embodiment.

As best seen in FIGS. 13E and 13F, side walls 114*d* of support 114 are similarly interconnected by a tubular-shaped member 130 that forms a generally wedge-shaped passage 115. Again, light assembly covers 138 are configured such that their outer surfaces generally follow the outermost perimeter of support 114—in other words, so that their outer surfaces follow the general contour and are flush and contiguous with the outer surfaces of side walls 114*d*. It should be understood, however, that covers 138 may instead project outwardly or may be recessed within recesses 116 to vary the appearance of post 110. For further details of how post 110 is assembled, reference is made to the previous embodiment.

Referring to FIGS. 14-20 and 20A-20D, lighted post 210 may include a round support 214 that is mounted to a circular base 212. In addition, cover plate 222 comprises a circular cover. Covers 238 may optionally have the same curvature as the side walls 214*d* of support 214 so that they follow the contour of support. Though it should be understood, similar to the previous embodiments, covers 238 may project outwardly and have a smaller radius of curvature than the side walls or may be recessed and have a larger radius of curvature than the side walls depending on the appearance that is desired.

In the illustrated embodiment, four recesses 216 are formed in curved side walls 214*d* and located at 90° intervals around the perimeter of support 214. Side walls 214*d* are similarly interconnected by a tubular member 230 and webs 232. As in the case of any of the embodiments, the number of recesses can be increased or decreased.

Light assemblies 236, which are of similar construction to light assemblies 36, are similarly mounted in longitudinal slots 229*c* formed between the lateral edges 229*a*, 229*b* of angled portions 228*a*, 228*b* of web walls 224*a*, 224*b*. In this embodiment, angled portions 228*a*, 228*b* may lie in a curved surface parallel to the side walls 214*d* or in a plane that is parallel to a tangent to the outermost perimeter of support 214 at recess 216. For further details of how post 210 is assembled, reference is made to the previous embodiments.

Referring to FIGS. 21-27 and 27A-27B, the numeral 310 generally designates yet another embodiment of the lighted post of the present invention. Lighted post 310 is of similar construction to lighted post 10 but includes recesses 316 located in the side walls 314*d* of support 314 between corners 314*c*. In the illustrated embodiment, each side wall 314*d* includes a recess (316) that is preferably centrally located between the corners of support 314. In addition, covers 338 project outwardly from the outermost perimeter of support 314. Although illustrated with only one recess, each side wall may incorporate more than one recess, including recesses at the corners of the support.

Figure 27:
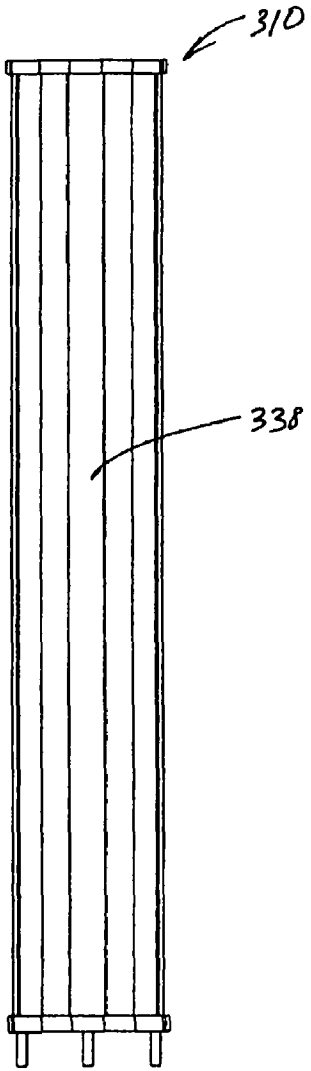
FIG. 27 is a rear elevation view of the lighted post of FIG. 22.
Figure 27A:
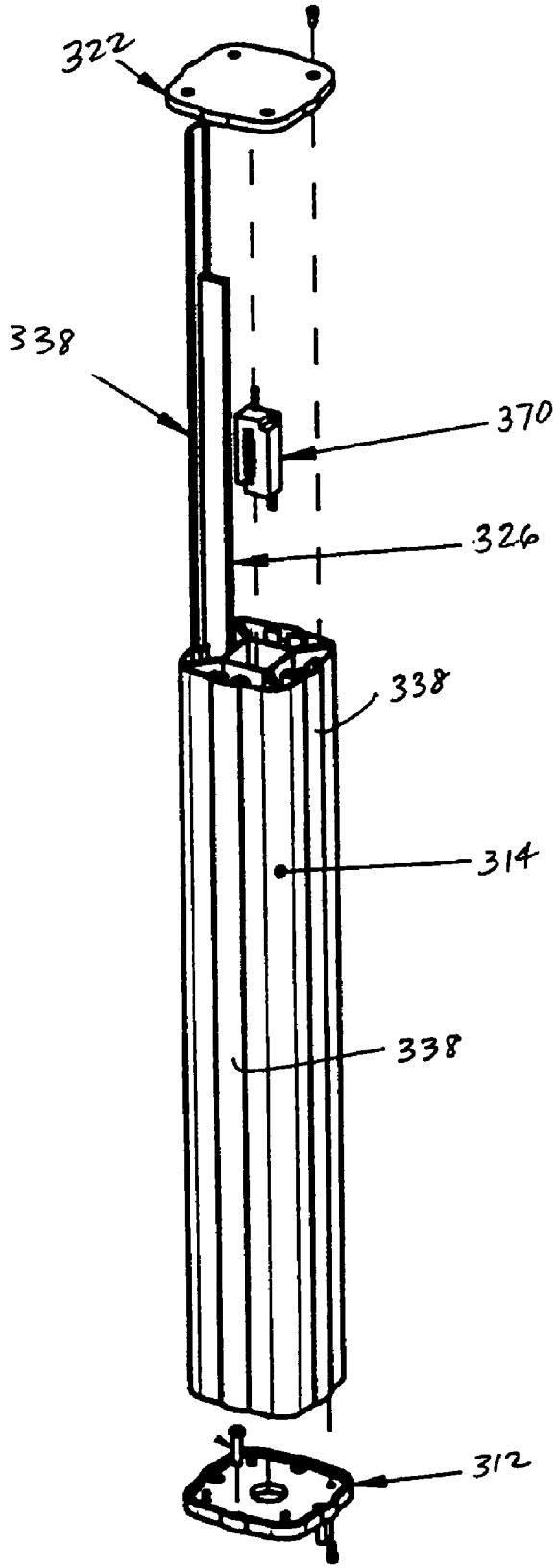
FIG. 27A is an exploded perspective view of the lighted post of FIG. 21.
Figure 27B:
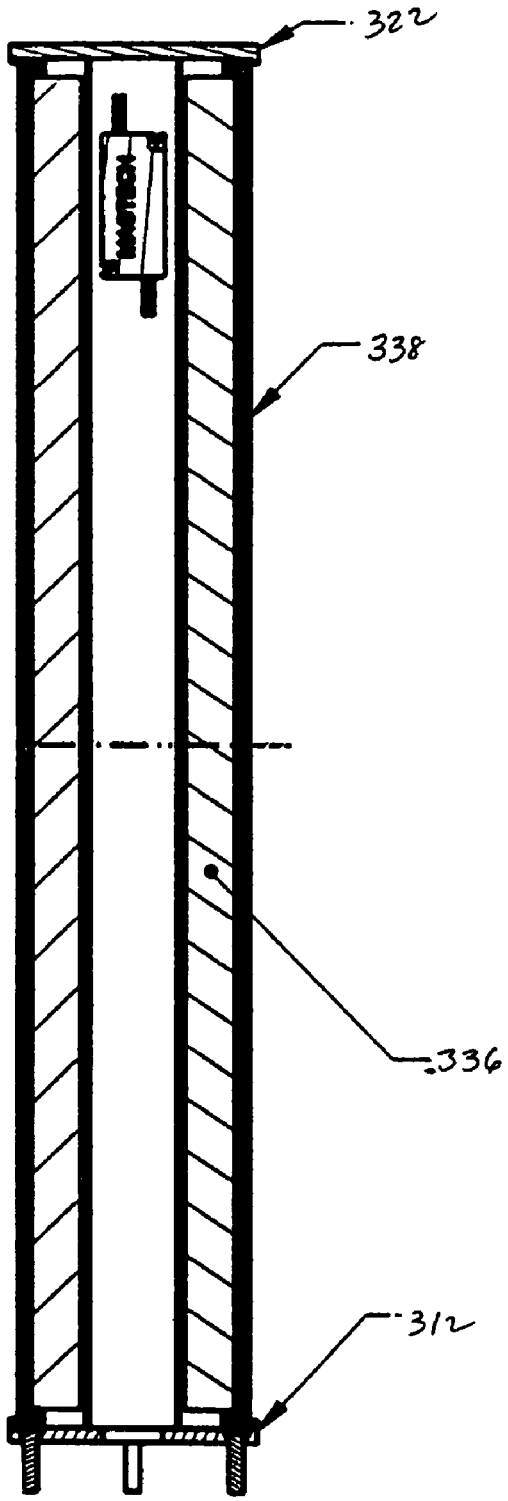
FIG. 27B is a cross-section taken along line XXVIIB-XXVIIB of FIG. 23.
Figure 27C:
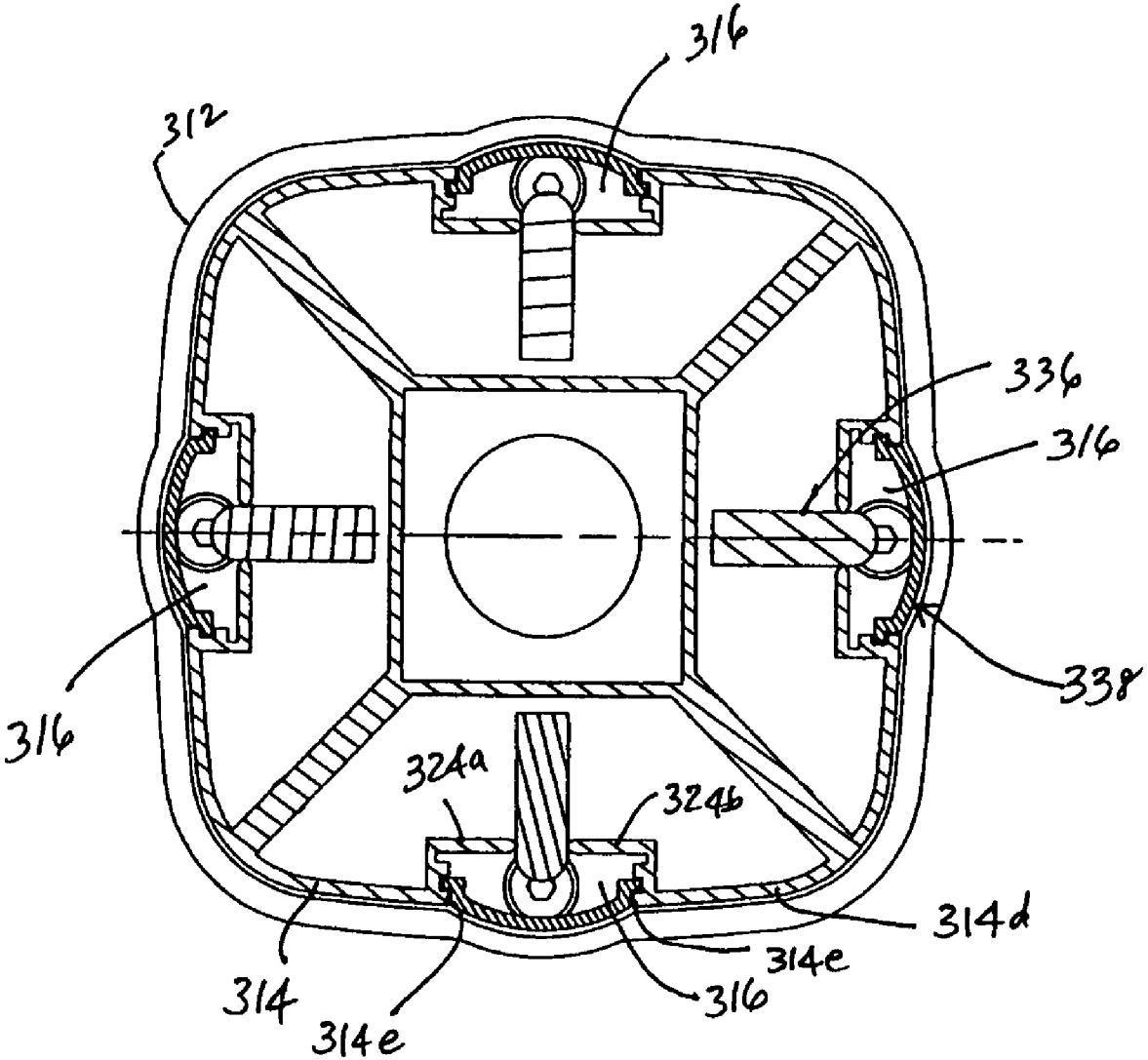
FIG. 27C is a cross-section taken along line XXVIIC-XXVIIC of FIG. 22.
Figure 27D:
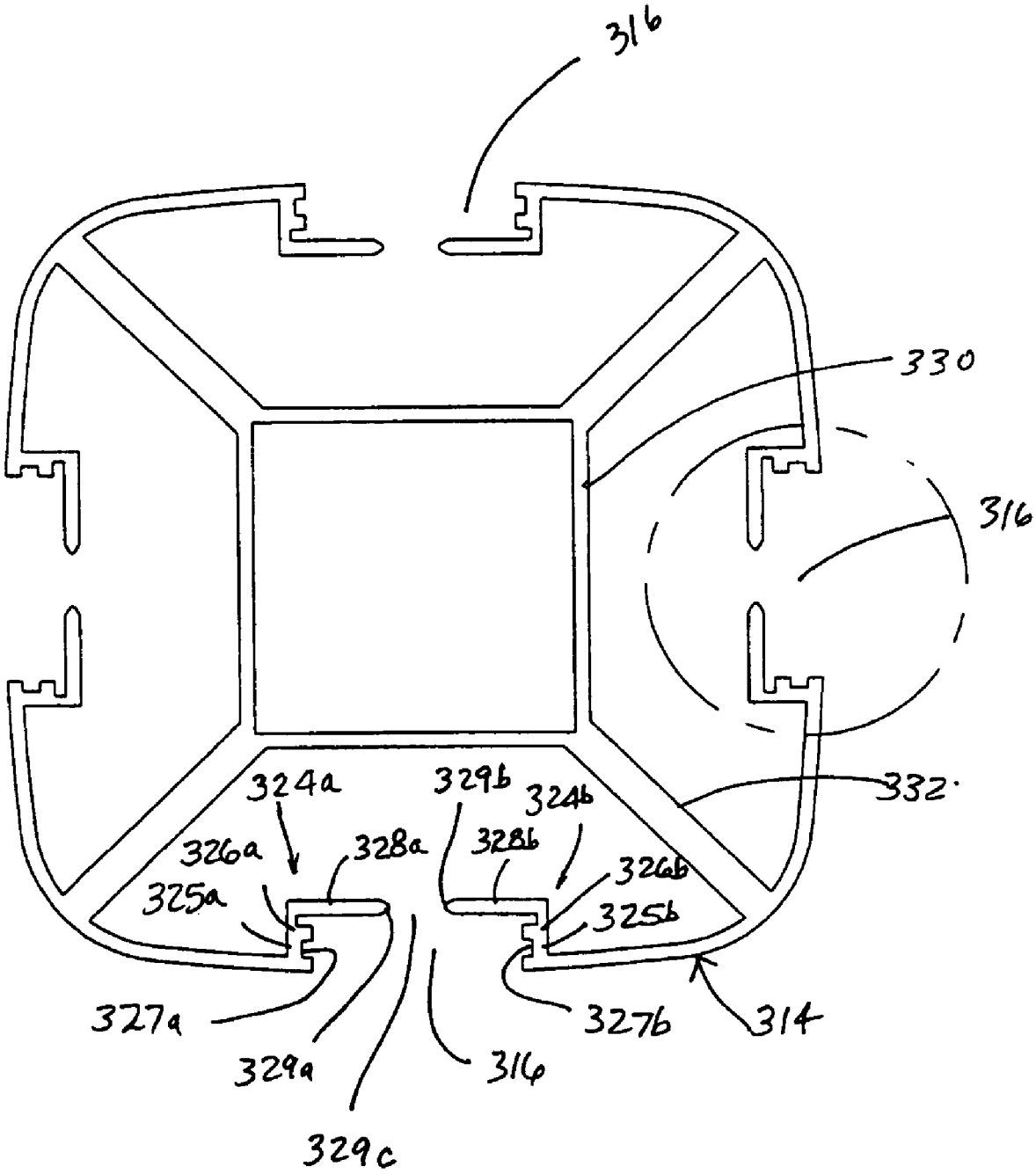
FIG. 27D is a top plan view of a lighted post of FIG. 22 with the support cover and the light assemblies removed for clarity.
Figure 30:
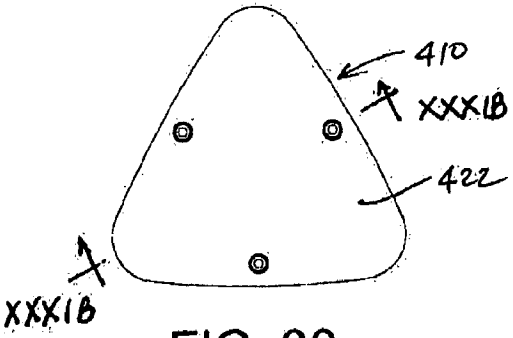
FIG. 30 is a top pan view of the lighted post of FIG. 29.
Figure 29:
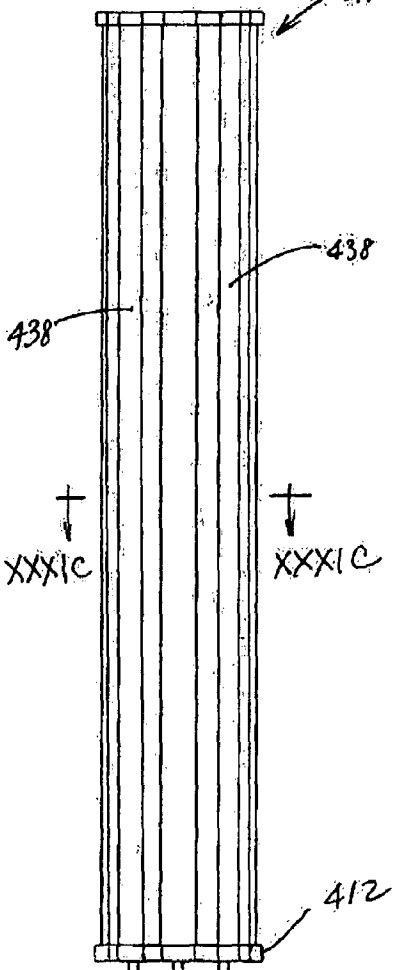
FIG. 29 is a front elevation view of the lighted post of FIG. 28.
Figure 28:
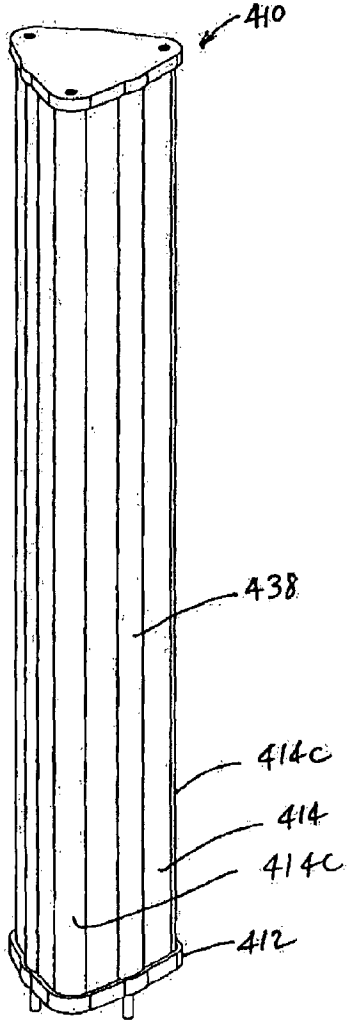
FIG. 28 is a perspective view of a fifth embodiment of the lighted post of the present invention.

As best seen in FIGS. 27C and 27D, recesses 316 are similarly formed between the terminal edges 314*e* of side walls 314*d* and between web walls 324*a*, 324*b*, which project inwardly from side walls 314*d*. Web walls 324*a*, 324*b* are similarly mirror images, with web walls 324*a*, 324*b* including base, intermediate, and inner or end portions 325*a*, 325*b*, 326*a*, 326*b*, and 328*a*, 238*b*, respectively, that form an E-shape configuration. The inner portions 328*a*, 328*b* of web walls 324*a*, 324*b* are extended toward each other with their respective distal edges 329*a*, 329*b* spaced apart to thereby form longitudinal slots 329*c* for holding and engaging the respective light assemblies in a similar manner to the previous embodiments. Base portions 325*a*, 325*b* and intermediate portions 326*a*, 326*b* similarly form longitudinal grooves or tracks 327*a*, 327*b* for retaining covers 338 therein.

Side walls 314*d* are also interconnected by a tubular member 330 and webs 332, but with the webs connecting to the side walls at the junctures of the side walls or corners 314*c* formed by the side walls 314*d*.

As noted above, covers 338 project outwardly from side walls 314*d*, which allows the light from the respective light assemblies to fan out over a greater angular range than if the covers were flush or sub-flush with the side walls. However, it can be appreciated that the covers may be flush or even recessed depending on the desired light pattern and appearance of the lighted post.

Referring to FIGS. 28-31, 31A, and 31B, the numeral 410 designates another embodiment of the lighted post of the present invention. Lighted post 410 is similar to lighted post 210 in that it incorporates a triangular-shape support 414, preferably a triangular-shaped extruded aluminum member, and triangular-shaped base 412 and triangular-shaped cover plate 422. Further, lighted post 410 is similar to lighted post 310 in that it incorporates recesses 416 in the side walls 414*d* of support 414 and, further, preferably in the medial portion of the side walls between corners 414*c* of support 414.

In addition, covers 438, like covers 338, project outwardly from the outermost perimeter of support 414 so that covers 438 form a discontinuity in the planar outer surfaces of side walls 414*d*, which create or form the look of light emitting ribs similar to covers 338. For further details of the light assemblies 436 and the general details of how the light assemblies are mounted, reference is made to light assemblies 36 of post 10.

Figure 31:
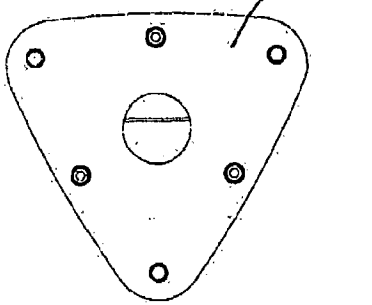
FIG. 31 is a bottom plan view of the lighted post of FIG. 29.
Figure 31A:
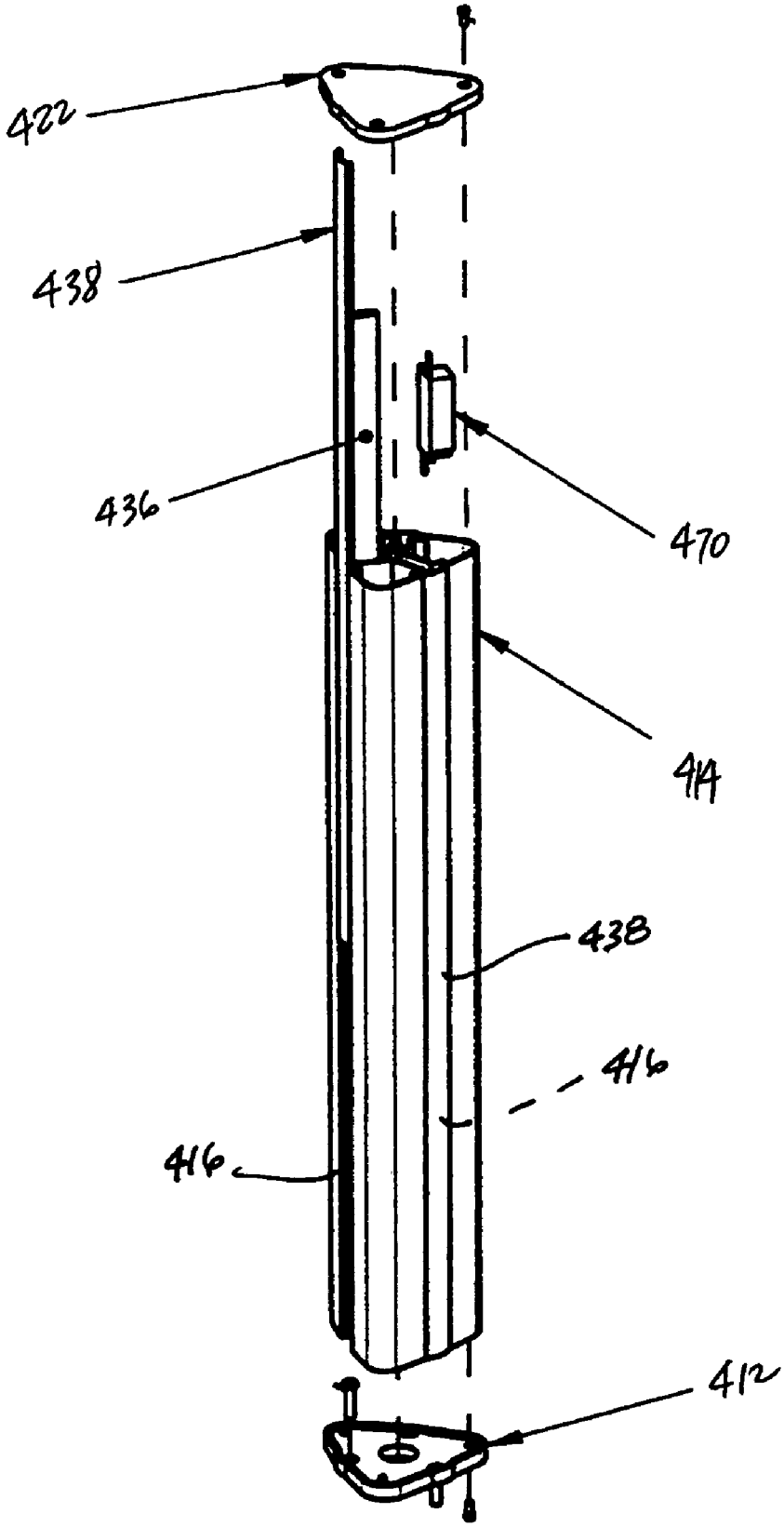
FIG. 31A is an exploded perspective view of the lighted post of FIG. 28.
Figure 31B:
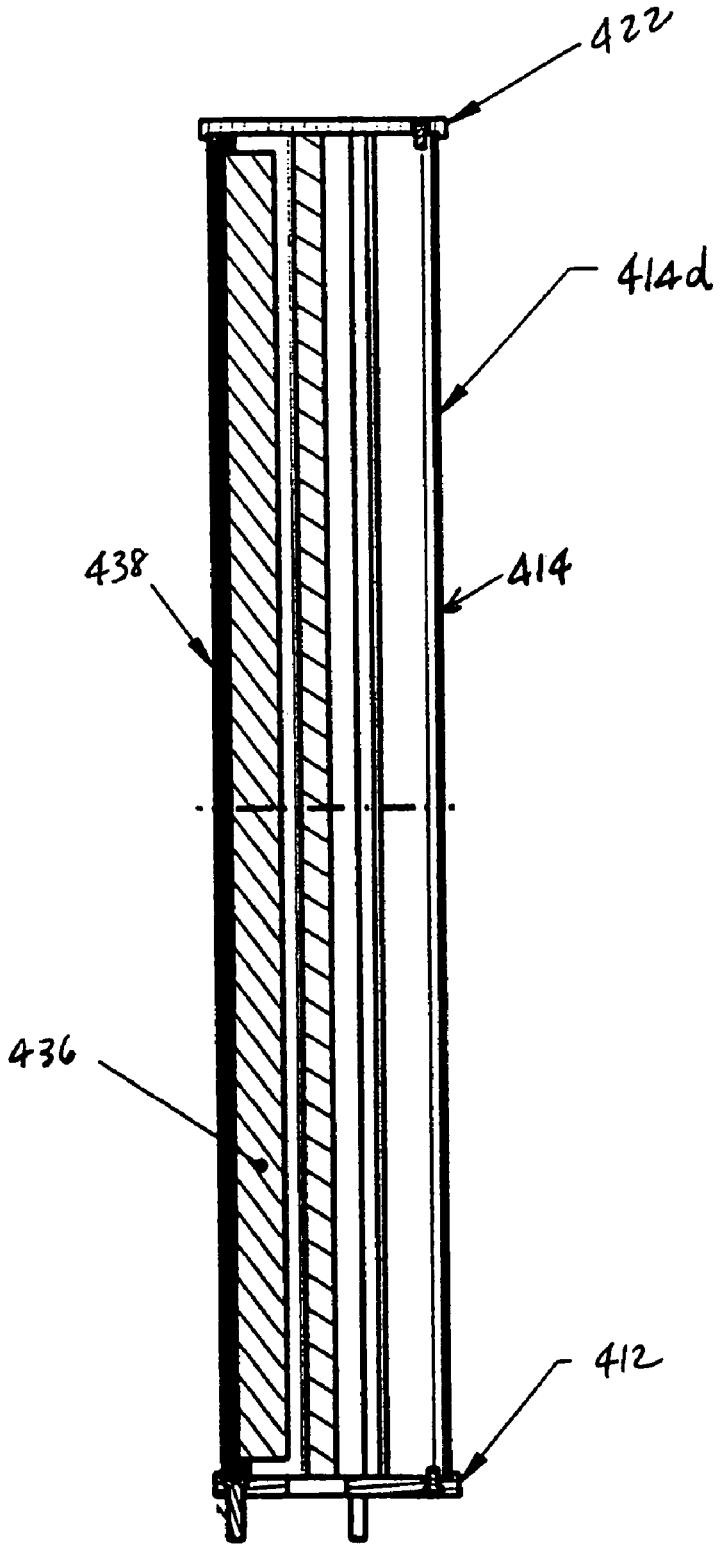
FIG. 31B is a cross-section taken along line XXXIB-XXXIB of FIG. 30.
Figure 31C:
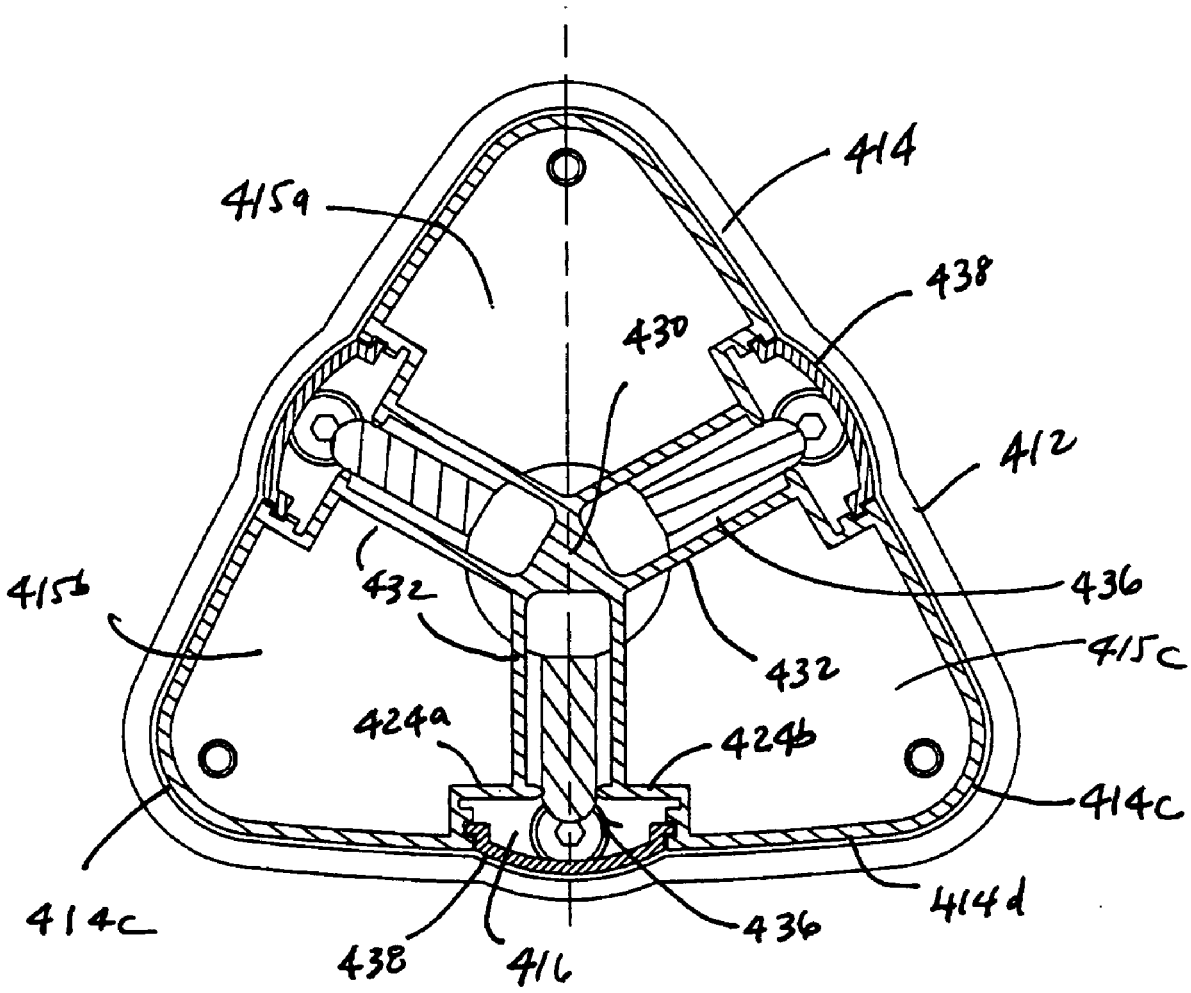
FIG. 31C is a cross-section taken along line XXXIC-XXXIC of FIG. 29.
Figure 31D:
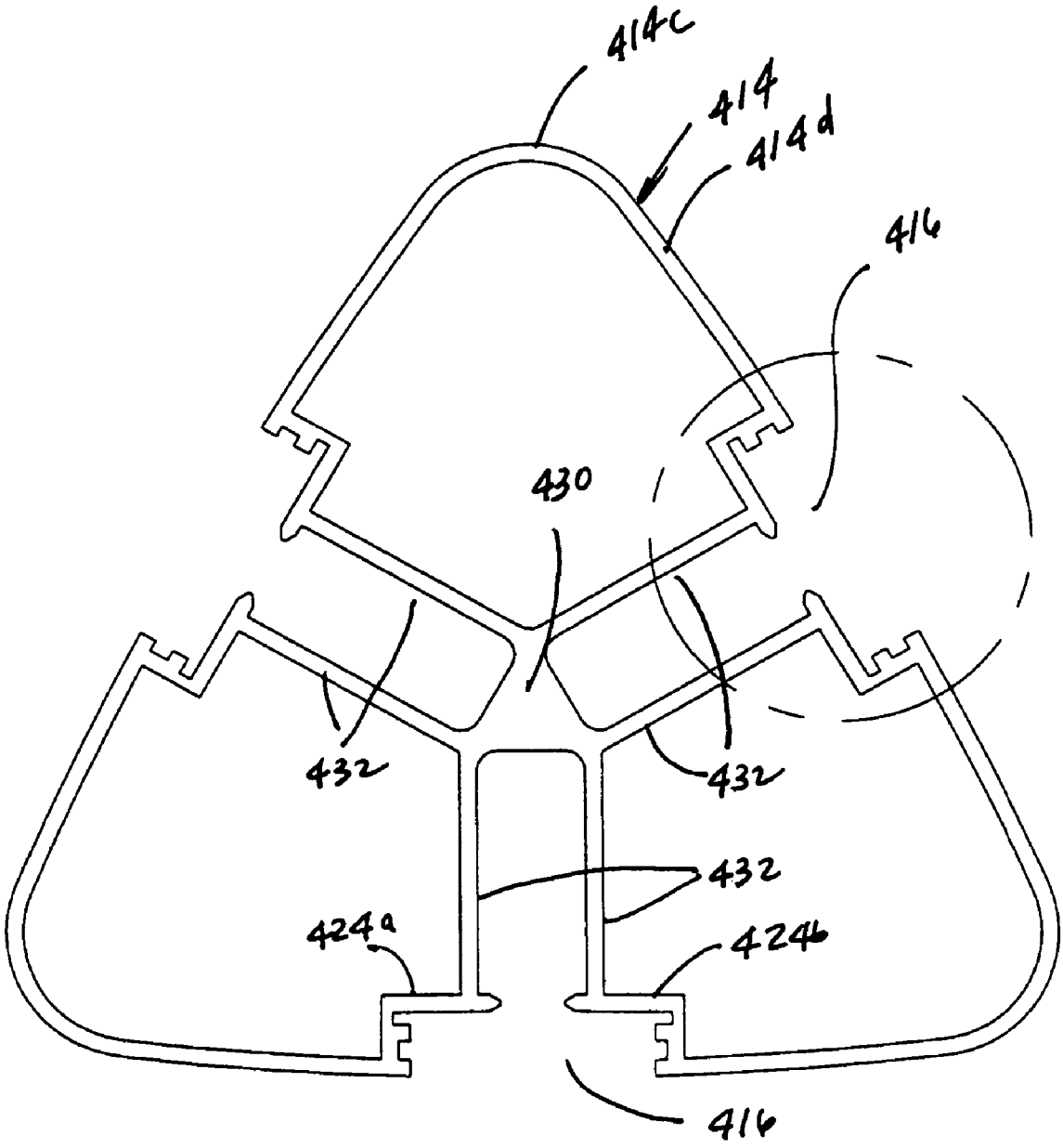
FIG. 31D is a top plan view of a lighted post of FIG. 29 with the covers and light assemblies removed for clarity.

Referring to FIGS. 31C and 31D, side walls 414*d* are interconnected by an elongate wedge-shaped member 430 and pair of web walls 432, which connect to web walls 424*a*, 424*b*. Web walls 424*a*, 424*b* are of similar construction to web walls 324*a*, 324*b* of the previous embodiment. In the illustrated embodiment, support 414 includes a plurality of elongate passages 415*a*, 415*b*, 415*c* that are formed between web walls 432 and side walls 415*d*. Therefore, in this embodiment, the driver (470) may be located in any one of passages 415*a*, 415*b*, and 415*c*, with the driver's wiring extending through openings provided in web walls 432 for connection to light assemblies 436, which extend from recesses 416 to the spaces defined between the respective pairs of web walls 432.

Referring to FIGS. 32-38, the numeral 510 generally designates another embodiment of the lighted assembly of the present invention in the form of a wall mounted lighted assembly, which adapted to mounted to a wall, W. In the illustrated embodiment, support 514 is similar to support 14 but is generally halved. For corner mounted applications, the support may be quartered to fit in a corner between two walls or three-quartered for a wrap-around design over an outer corner.

In addition, in the illustrated embodiment, support 514 includes two light assemblies 536 at its respective corners; however, it can be appreciated that the number of light assemblies may be varied and, further, may be provided at different locations, as described in greater detail below. For further general details of support 514, reference is made to support 14.

Optionally lighted assembly 510 may be configured to create a wall mounted "sconce" that would match the bollard or pathway light formed by lighted post 10, for architectural consistency in lighting a site, building or the like. For example, lighted assembly 510 may optionally include a base 512 (similar to base 12) and a cover 522 (similar to cover 22), which are secured to the opposed ends of support 514 by fasteners 512*c* and 522*a* similar to the previous embodiments. However, because it is wall mounted, base 512 may not need anchor bolts. For example, where lighted assembly 510 is mounted to a wall and spaced from the ground surface, the anchor bolts and corresponding mounting openings in base 512 may be eliminated. In addition, in this configuration, the wiring or cable may be extended from support 514 through side of support 514 that faces the wall and through an opening provided in the wall, thus eliminating the need for any openings in base 512 other than for securing base 512 to support 514.

In the illustrated embodiment, support 514 is mounted to wall W by fasteners that extend into support 514, such as in web walls 532, so that the fasteners are not visible. For example, hooks or anchors may be mounted to wall W, which engage mounting openings 514*a*, such a keyhole shaped openings (FIG. 38), provided on the wall facing side of support 514A, such as web walls 532. In addition, central member 530, which is interconnected to the outer side walls of support 514 by web walls 532, includes openings 530*a* to provide passageways for wiring to connect to the light assemblies 536 that are located in the cavities formed at the corners of support 514 by the outer side walls, web walls 532, and member 530 of support 514.

Figure 32B:
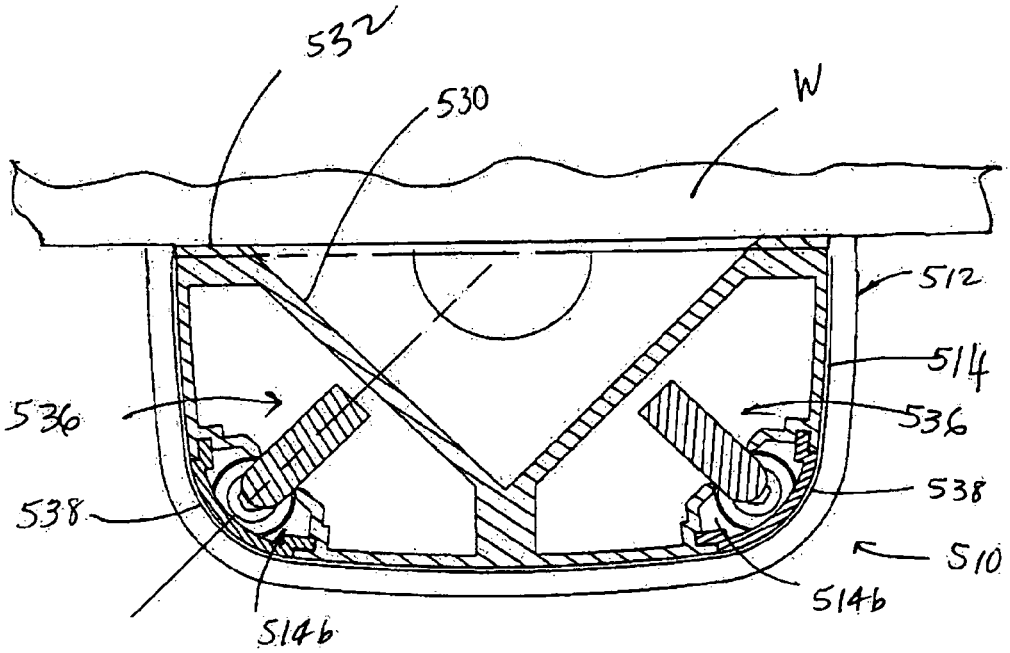
FIG. 32B is a cross-section taken along line XXXIIB-XXXIIB of FIG. 32.

Referring to FIGS. 32A and 32B, support 514, similar to support 14, includes longitudinal recesses 514*b* formed at each of its outer corners in which light assemblies 536 are located and supported in a similar manner described in reference to light assemblies 36. Further, light assemblies 536 are enclosed in recesses 514*b* by covers 538.

Referring to FIGS. 39-45, the numeral 610 generally designated another embodiment of the wall mounted lighted assembly with a support 614, base 612, cover 622, light assemblies 636, and covers 638 similar to the previous embodiment. In addition, support 614 includes mounting openings 614*a* for mounting assembly 610 to a wall to create a lighted sconce similar to the previous embodiment.

In the illustrated embodiment, support 614 has a triangular-shaped cross-section and may be formed from a section of support 114, for example. However, support 614 includes additional web walls 614*b* (FIGS. 39A and 45) to provide a mounting surface and location for mounting openings 614*a*.

Referring to FIGS. 46-52, the numeral 710 generally designated another embodiment of the wall mounted lighted assembly with a support 714, base 712, cover 722, light assemblies 736, and covers 738 similar to the previous embodiments. In addition, support 714 includes mounting openings 714*a* for mounting assembly 710 to a wall to create a lighted sconce similar to the previous embodiments.

In the illustrated embodiment, support 714 has a semi-circular cross-section and may be formed from a halved section of support 214, for example, with web walls 714*b* (FIGS. 46A and 52) providing a mounting surface and location for mounting openings 714*a*.

Referring to FIG. 53, the cross-sections of the square-shaped supports may be varied. For example, support 814, rather than including a central tubular member (such as member 30 in the first embodiment), includes discrete three-sided web walls 832 that straddle each corner recess 816, where light assemblies 836 are located. Web walls 832 define there between a cross-shaped passage way 815 that extends between outer side walls 814*d* and between the central sides 832*b* of web walls 832. The light assemblies' driver 870 may be located in passageway 815.

In addition, outer side walls 814*d* optionally include elongated c-shaped ribs 814*e*, which form threaded bosses or passageways, similar to bosses 32*a*, for the fasteners to extend into and engage to support 814 to secure the respective cover or base to support 814.

Referring to FIG. 54, the cross-sections of the triangular-shaped supports may be varied. For example, rather than including enlarged web-walls (such as web walls 132 at the juncture of member 130 with side walls 114*d* (see FIG. 13F)), support 914 may include elongated c-shaped ribs 914*e* at side walls 914*d* between web walls 932, which form bosses or passageways for fasteners to extend and engage support 914 for mounting the respective cover or base to support 914. As would be understood from the description of the previous embodiments, each web wall 932 includes one of more openings formed therein to permit the wiring to extend from passageway 915 to the respective cavities formed between web walls 932 and the outer side walls 914*d* where the light assemblies are located.

Referring to FIG. 55, the cross-sections of the circular-shaped supports may be varied. For example, support 1014, rather than including a central tubular member (such as member 230 in the third embodiment), includes discrete three-sided web walls 1032 that straddle each recess 1016, where light assemblies 1036 are located. Web walls 1032 define there between a generally cross-shaped passage way 1015 that extends between outer side walls 1014*d* and between the central sides 1032*b* of web walls 1032. The light assemblies' driver 1070 may be located in passageway 1015.

Similar to support 814, outer side walls 1014*d* optionally include elongated c-shaped ribs 1014*e*, which form bosses or passageways for fasteners to extend and secure the cover or base to support 1014.

Although the various embodiments of the supports are illustrated as a single extruded member, it should be understood that any one of the extruded members may be assembled from two or more extruded components. For example, in reference to FIG. 56A, support 1114, which is of similar construction to support 814, is assembled from four extruded components 1114*a*, 1114*b*, 1114*c*, and 1114*d* which are pinned together at joints 1115*a*, 1115*b*, 1115*c*, and 1115*d* provided between each of the extruded members. Each joint 1115*a*-1115*d* comprises a sliding joint, with one of the components having a groove 1116*a* and the other component having an enlarged flange 1117*a*, which are formed in the webs of the respective components. Flange 1117*a* slides into the respective groove to thereby form the sliding joint. The flanges are then fastened in place by fasteners, such as a pin 1118*a*, to form support 1114.

Similarly, as best seen in FIG. 56B, support 1214, which is similar to support 914 is also assembled from three extruded components, 1214*a*, 1214*b*, and 1214*c* each connected at a joint similar to joints 1115*a*-1115*d* of support 1114. Support 1314, illustrated in FIG. 56C, is assembled from four extruded members 1314*a*, 1314*b*, 1314*c*, and 1314*d* that are pinned together in a similar fashion described in reference to the previous embodiments.

For further details of each support 1114, 1214, and 1314, reference is made to the previous embodiments. By forming the supports from several extruded components, significant savings can be realized in the manufacturing costs. It should be understood that the number of extruded components to form each support and the location of the joints can be varied.

In addition, although not necessary, any one of the lighted assemblies of the present invention may incorporate reflectors or diffusers or the like. For example, reflective surfaces may be provided or formed on the inner surfaces of the respective recesses. Reflective surfaces may be provided by metal reflectors or reflective tape or reflective coatings. The diffuser may be interposed between the light assembly and the cover. Alternately, the light covers (38, 138, 238, 338, 438, 538, 638, and 738) may be formed as diffusers and may be tinted either during the molding process or tinted by a coating or film applied to the covers.

As noted previously, the various components forming the structure of the lighted assemblies of the present invention may be formed from a wide variety of materials, including plastic. A suitable plastic may include some percentage of recycled materials, including post consumer recycled (PCR) material, depending on the application. In addition, at least the exterior surfaces of the components may be painted, coated, including powder coated, stained or the like, as desired. For plastic components, the components may be assembled using welding and/or fastening devices, such as screws, bolts, rivets or the like. Notably, all of the structural components comprising the lighted post may be plastic given the low heat output from the light assembly (or light assemblies). In addition, when formed from plastic, the components may be formed, such as by molding, from more than one type of material. For example, any one of the components may be formed from two or more plastics using two-shot molding or the like or may be formed from a composite material and formed, for example, by insert molding. For example, when a reflective surface is desired, the component may be formed by insert molding the reflector into the component.

While several forms of the invention have been shown and described, other forms will now be apparent to those skilled in the art. For example, as described in reference to the wall-mounted lighted assemblies, due to the extruded nature of the supports, any one of the supports may be vertically sectioned, for example halved, so that they can be mounted on a wall as illustrated, or in a corner, to form a sconce that would match the bollard or pathway light to provide architectural consistency in lighting a site, building or the like. Further, features of one embodiment may be incorporated into or substituted for features in another embodiment. Furthermore, the size, shape, and general cross-section of the extruded members, covers, and bases may be varied. In addition, as noted the light assemblies may be permanently mounted in the support. For example, the light assemblies may be molded in the shape of the recess so that when it is inserted into the end of the support, the light assembly substantially fills the void formed in the recess so that the light assemblies are embedded into the wall of the support, thus eliminating the need for a cover. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

The embodiments of the invention in which we claim an exclusive property right or privilege is claimed are defined as follows:

1. A lighted assembly comprising:

a support comprising a hollow member defining an enclosure, said hollow member having a wall defining an outer perimeter surface of said support;

a light assembly having a light source and a light transmitting body having a light emitting surface, said light source being coupled to said body, said light assembly being adapted for coupling to a power source for powering said light source, when powered light from said light source being directed into said body and being directed from said body through said light emitting surface; and said wall of said support having offset portions forming a recess extending inwardly of said outer perimeter surface and having an opening therein in communication with said enclosure, said light assembly being mounted in said enclosure and extended into said recess through said opening in said recess and facing outwardly from said support at said recess to thereby direct light outwardly from said support.

2. The lighted assembly according to claim 1, wherein said hollow member has a multi-sided cross-section with a plurality of sides.

3. The lighted assembly according to claim 2, wherein said hollow member includes a plurality of corners, said recess is located in one of said corners of said support.

4. The lighted assembly according to claim 2, wherein said recess is located in one of said sides of said hollow member support.

5. The lighted assembly according to claim 1, wherein said hollow member comprises an extruded member, said wall forming a plurality of said recesses.

6. The lighted assembly according to claim 5, further comprising a light assembly provided at each of said recesses.

7. The lighted assembly according to claim 6, wherein each of said recesses includes a cover, said covers enclosing said light assemblies in said recesses.

8. A lighted, comprising:

a support having a wall;

a light assembly having a light source and a light transmitting body having a light emitting surface, said light source being coupled to said body, said light assembly being adapted for coupling to a power source for powering said light source, when powered light from said light source being directed into said body and being directed from said body through said light emitting surface;

said support including a recess formed in said wall, said light assembly being mounted in said recess and facing outwardly from said support to thereby direct light outwardly from said support;

wherein said support comprises an extruded member with a plurality of recesses formed in said wall of said support; and said light assembly comprising a plurality of light assemblies with at least one of said light assemblies provided at each of said recesses, wherein said recesses extend from an upper end of said support to a lower end of said support.

9. The lighted assembly according to claim 8, wherein each of said light emitting surfaces extends substantially from said upper end to said lower end of said support.

10. The lighted assembly according to claim 7, wherein said support includes opposed grooves at said recess, said covers engaging said support at said grooves.

11. The lighted assembly according to claim 8, further comprising a cover mounted to said upper end and a base mounted to said lower end.

12. The lighted assembly according to claim 1, wherein each light assembly is configured such that light emitted from said light emitting surfaces has a substantially uniform light intensity.

13. The lighted assembly according to claim 12, wherein each of said light assemblies includes a plurality of light emitting diodes, such as a plurality of high intensity emitting diodes.

14. A lighted assembly comprising:

a support, said support comprising a hollow member with an upper open end and a lower open end and an outer perimeter surface;

a cover, said cover mounted to said upper open end and closing said upper open end;

a light assembly having a plurality of light emitting diodes and a light transmitting body having a light emitting surface, said light assembly being adapted for coupling to a power source for powering said light emitting diodes;

said hollow member being formed with at least one recess that extends along the longitudinal length of said hollow member inwardly from said outer perimeter surface from said upper open end to said lower open end; and said light assembly mounted in said support such that at least a portion of said body is located in said recess so that light projects outwardly from said recess of said support when said light emitting diodes are powered.

15. The lighted assembly according to claim 14, wherein said hollow member comprises a hollow metal member.

16. The lighted assembly according to claim 14, wherein said hollow member comprises an extruded hollow member.

17. The lighted assembly according to claim 14, wherein said hollow member includes at least three sides and at least three corners.

18. The lighted assembly according to claim 17, wherein said recess is located at one of said corners.

19. The lighted assembly according to claim 17, wherein said hollow member includes a plurality of recesses, at least one of said light assemblies being located in one of said recesses.

20. The lighted assembly according to claim 19, wherein said recesses are located at said corners.

21. The lighted assembly according to claim 19, wherein said recesses are located in said sides.

22. The lighted assembly according to claim 14, wherein said hollow member includes a central tubular-shaped member.

23. The lighted assembly according to claim 22, wherein said central tubular-shaped member forms a passageway through said support.

24. The lighted assembly according to claim 14, wherein said lighted assembly comprises a lighted post.

25. The lighted assembly according to claim 14, wherein said lighted assembly comprises a wall mounted light assembly.

26. The lighted assembly according to claim 14, wherein hollow member is formed from a plurality of hollow components.

27. The lighted assembly according to claim 26, wherein said hollow components are secured together by pins to form said support.

28. A method of assembling a lighted assembly comprising:

providing a support, the support being adapted for mounting to a wall or to a generally horizontal surface, the support having a support wall defining an enclosure and having an outer perimeter, and the support wall having offset portions forming at least one recess in said support wall along the length of the support;

locating a light assembly in the enclosure, the light assembly having a light transmitting body and at least one light source for directing light into the light transmitting body, the light transmitting body having a light emitting surface emitting light directed into the light transmitting body from the light source when the light source is powered;

positioning at least a portion of a light transmitting body in the recess wherein the light emitting surface is located at or near the outer perimeter of the support wall; and enclosing the light assembly in the support wherein the support is substantially free from bug intrusion into the support.

29. The method according to claim 28, wherein the light assembly is enclosed in the support by a cover, the cover being mounted over the recess and over the light emitting surface.

* * * * *

UNITED STATES PATENT AND TRADEMARK OFFICE

CERTIFICATE OF CORRECTION

PATENT NO. : 7,628,505 B2
APPLICATION NO. : 11/472900
DATED : December 8, 2009
INVENTOR(S) : Richard A. Flaherty It is certified that error appears in the above-identified patent and that said Letters Patent is hereby corrected as shown below:

Column 15:
Line 26, Claim 8, Delete "," after "lighted".
Line 26, Claim 8, Insert --assembly-- after "lighted".

Signed and Sealed this

Thirtieth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,628,505 B2
APPLICATION NO. : 11/472900
DATED : December 8, 2009
INVENTOR(S) : Richard A Flaherty It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 662 days.

Signed and Sealed this

Twenty-first Day of December, 2010

David J. Kappos

David J. Kappos
*Director of the United States Patent and Trademark Office*